US009415624B1

(12) United States Patent
Bedinghaus

(10) Patent No.: US 9,415,624 B1
(45) Date of Patent: Aug. 16, 2016

(54) MOVING STEP ARTICLE AND METHOD

(71) Applicant: William C. Bedinghaus, St. Petersburg, FL (US)

(72) Inventor: William C. Bedinghaus, St. Petersburg, FL (US)

(73) Assignee: Sandy Alexander, Inc., Clifton, NJ (US)

( * ) Notice: Subject to any disclaimer, the term of this patent is extended or adjusted under 35 U.S.C. 154(b) by 230 days.

(21) Appl. No.: 13/650,332

(22) Filed: Oct. 12, 2012

Related U.S. Application Data

(60) Provisional application No. 61/627,622, filed on Oct. 13, 2011.

(51) Int. Cl.
*B42F 17/18* (2006.01)
*B42D 3/04* (2006.01)

(52) U.S. Cl.
CPC .. *B42F 17/18* (2013.01); *B42D 3/04* (2013.01)

(58) Field of Classification Search
CPC ..... B42F 17/18; B42F 5/005; B65D 85/544; G11B 33/045; B42D 5/005; B42D 5/022; B42D 3/04
USPC ..... 40/391, 388, 124.02; 206/311; 229/69; 281/22, 32, 33, 38; 211/11, 53, 55; 283/38
See application file for complete search history.

(56) References Cited

U.S. PATENT DOCUMENTS

| | | | | | |
|---|---|---|---|---|---|
| 864,984 | A | | 9/1907 | McPhee | |
| 958,582 | A | | 5/1910 | Bodine | |
| 1,415,429 | A | | 5/1922 | Cueny | |
| 1,431,714 | A | * | 10/1922 | Wilking | 206/311 |
| 1,603,362 | A | | 10/1926 | Stewart | |
| 2,105,696 | A | | 1/1938 | Lewis | |
| 2,177,071 | A | * | 10/1939 | Klein et al. | 40/400 |
| 2,253,858 | A | | 8/1941 | Lucas et al. | |
| 2,287,365 | A | * | 6/1942 | Widder et al. | 206/311 |
| 2,595,972 | A | | 5/1952 | Naurison | |
| 3,008,248 | A | | 11/1961 | Steinthal | |
| 4,150,844 | A | * | 4/1979 | Yoshizawa | 281/19.1 |
| 4,441,270 | A | | 4/1984 | Crowell et al. | |
| 4,706,396 | A | * | 11/1987 | Nomura | 40/124.2 |
| 5,630,626 | A | * | 5/1997 | Harper | 281/38 |
| 6,246,461 | B1 | | 6/2001 | Hinsberg | |
| 2012/0112449 | A1 | * | 5/2012 | Engel et al. | 281/15.1 |

* cited by examiner

*Primary Examiner* — Syed A Islam
(74) *Attorney, Agent, or Firm* — Frijouf, Rust & Pyle, P.A.

(57) ABSTRACT

An improved moving step article construction and method of making is disclosed. The moving step article comprises an exterior cover having a hinge fold positioned between a front cover and a rear cover. The front cover has an obverse side and a reverse side. The rear cover has an obverse side and a reverse side. An interior leaf has an obverse side, a reverse side, an inner edge and an outer edge. The interior leaf defines a leaf width. A binder couples the inner edge of the interior leaf with the reverse side of the front cover for defining a leaf offset dimension between the hinge fold and the inner edge of the interior leaf. The leaf offset causes the interior leaf to be displaced relative to the rear cover during pivoting the front cover between a closed position and an open position.

10 Claims, 29 Drawing Sheets

MOVING STEP ARTICLE AND METHOD

CROSS-REFERENCE TO RELATED APPLICATIONS

This application claims benefit of U.S. Patent Provisional application Ser. No. 61/627,622 filed Oct. 13, 2011. All subject matter set forth in provisional application Ser. No. 61/627,622 is hereby incorporated by reference into the present application as it fully set forth herein.

BACKGROUND OF THE INVENTION

1. Field of the Invention

This invention relates to printed matter and more particularly to the improved moving step article and method of making.

2. Background of the Invention

The history of printing started with the duplication of images around 3000 BC. It evolved from the use of round cylinder seals to impress clay tablets in Mesopotamia. Block printing on cloth preceded printing on paper, which became common by the mid 1400's. The origin of moveable type is credited to the Chinese around 1040, with metal moveable type appearing around 1230. These systems were not widely used due to the extensive set of characters. In 1439 the development of moveable type printing technology firmly established modern moveable type printing. Lithographic printing appeared in the late 1700's. Color printing, offset printing, screen printing, and flexography were further developments in the printing art. In the 1960's and 1970's, photocopiers, thermal, dot matrix, inkjet, and laser printers were introduced. The quality and desired appearance of the printed product is controlled by many criteria. A several considerations include printing press to be used and substrate type. Substrate determinations must consider the weight, density, opacity, paper grain, coating, moisture content, porosity and ink absorbency.

Coincident with the evolution and development of printing technology graphic design developments and improvements also progressed. Binding and finishing developments enhanced the appearance of the final primed product. The processes of cutting, collating, folding, and mechanical, chemical and thermal fastening enable the graphic designer to produce a wide variety of printed products. Many styles and designs of multi-page graphic design pieces have appeared. The uniqueness of print media styles provides an attraction to the viewer. This is especially true of advertising media, where each significant difference from the media produced by the advertiser's competition, provides an advertising advantage. Examples of these improvements include a brochure or card wherein upon opening the card, an interior portion of a card moves relative to the base card. A three dimensional variation of the movement effect includes so called "pop ups" whereby upon opening a folded card or brochure, a three dimensional pylon rises from the surface of the card, These effects are achieved through proper cutting folding and mounting and binding of the moveable piece or pylon on the interior surfaces of the card or brochure. Although these effects are well known to those skilled in the art, there still exists the challenge to produce print media pieces having unique motions or effects in order to achieve a competitive advantages over other print pieces.

There have been many in the prior art who have attempted to solve these problems with varying degrees of success. None, however completely satisfies the requirements for a complete solution to the aforestated problem. The following U.S. Patents are attempts of the prior art to solve this problem.

U.S. Pat. No. 864,894 to McPhee discloses a magazine card folder comprising a case of having a suitable back and cover joined together and a plurality of leaves formed of a length of suitable material arranged in folds. The folds form two sets of sections of different lengths and alternatively occur in the same length. The adjoining sections have their inner surfaces joined together to form leaves. The inner leaf is mounted on the back. Means engage the uppermost section and displaying the pages of the various leaves in turn, as and for the purpose specified.

U.S. Pat. No. 958,582 to Bodine discloses a signature for combination fashion and simple books comprising two or more pairs of stiff sheets joined together by binding tape to provide stitching and binding means. One or more flexible fashion sheet interleaves are interposed between each two pairs of thick sheets. Stitching threads extend through the stitching and binding tapes of the thick sheets and interposed flexible sheets.

U.S. Pat. No. 1,415,429 to Ceuny discloses a display album having in combination a plurality of leaves, a pair of covers comprising rectangular frames hinged together and having, panels fitted therein to provide recesses at both the inner and outer sides of the covers. The construction being such that the inner recesses will receive the leaves and the inner faces of the frames will abut each other when the album is closed so that the edges of the leaves will then be entirely enclosed within the frames. An expandable binder secures the leaves to the covers. A thickened pedestal centrally located beneath the lower side of each frame firmly supports the album in upright position whether the same is opened or closed. A clasp positively secures the covers in close position.

U.S. Pat. No. 1,603,362 to Erskine discloses a receptacle display means comprising a series of foldable and expansible paper receptacles of varying site arranged one upon the other in face-to-face relation with the mouth portions of the receptacles contained in the same plane to facilitate individual expansion of the receptacles. The contacting sides of the receptacles are united for mutual support and to enable all of the receptacles to be expanded and collapsed in unison.

U.S. Pat. No. 2,105,696 to Lewis discloses an apparatus comprising a base, a swinging leaf having a free edge and an opposite heel edge, a swinging anchoring member hingedly connecting a base with the leaf at a point on the latter between the edges and adjacent to the heel edge and means connected with the heel edge of the leaf for swinging the latter.

U.S. Pat. No. 2,253,858 to Lucas et al. discloses an automatic page turning block comprising a plurality of stiff sheets of like sides stacked in staggered formation, the rear margin of each but the top sheet protruding to the back from under the overlying sheet. A pocket has a bottom, rear and top wall. The top wall extends short of the back edge of the top sheet of the plurality of sheets. When the plurality of sheets are inserted in the stacked staggered formation into the pocket and the rear edge of the bottom sheet of the plurality of sheets substantially abuts against the rear wall. A flexible tape extends over and is attached upon the protruding rear margins of the sheets and upon a corresponding rear margin of the top one of the plurality of stiff sheets and folded back from the rear margin of the top sheet onto and attached upon the top wall so that the sheets will be successively swung up when the stacked plurality of sheets are pulled out from the pocket. A guide means extends from the bottom wall and confines the bottom one of the plurality of sheets bottomwise and transversely went the plurality of sheets are pulled out from the pocket.

U.S. Pat. No. 2,595,972 to Naurison discloses a device including a pair of substantially coextensive members fixed in relation to each other. A slide is movable between the members. A strip extends between and is secured to the slide and a selected one of the members and a plurality of leaves. The leaves when the slide is positioned substantially wholly between the members are superimposed one upon the other and then positioned between the slide and the selected number. The leaves when the slide is moved out from a positioned substantially wholly between the members is rotated in spaced radial relationship to a positioned substantially on top of the selected member.

U.S. Pat. No. 3,008,248 to Steinthal discloses a sample swatch display book comprising front and back covers to form retaining material. An accordion pleated sheet of flexible material extending between and secured at opposite ends to the front and back covers respectively. The sheet contains a plurality of hinge folds form expandable traverse pleats. Each pleat has an inside hinge fold and a pair of leaves extending from the hinge fold towards respective outside hinge folds integrally connected the pleat to adjacent flanking pleats. One leaf of each pleat is nearer to the front cover than the other leaf of the pleat in close position of the book. Reinforcing strips of rigid material are secured to and line the leaves respectively of the pleats to impart form retaining rigidity to the leaves between hinge folds. A plurality of sample backing sheets. A different sample swatch is secured flat to each of the backing sheets. The backing sheets are large enough to support substantially the entire area of the swatches. The covers are large enough to cover substantially the entire area of the backing sheets in the closed position of the book. Snap fasteners means are near one end of each backing sheet. Snap fastener means are secured to each of those reinforcing strips which are secured to the nearer leaves of the pleats and constitute mates to the snap fastener means on the corresponding backing sheet. Each backing sheet has its snap fastener means releasably engaging the snap fastener means on the corresponding reinforcing strip with the backing sheet flat against the reinforcing strip and with the sample swatch disposed on the side of the backing sheet facing towards the front cover in close position of the book. The leaves in between the nearer leaves are free from attachments to swatch backing sheets and the fastener means on each backing sheet and on the corresponding reinforcing strip being protectively sandwiched in close position of the book between a pair of the in between strip reinforcing leaves located on opposite sides of and adjacent to the leaf supporting the latter backing sheet and the latter reinforcing strip.

U.S. Pat. No. 4,441,270 to Crowell, et al. discloses a multipage folder having a staggered array of interleaved pages successively flipped by manual actuation of a drawstrip. The folder includes a back cover panel bounded by a right fold line joining it to an overlying contiguous base panel. A central slot formed near the fold line joins the back panel and the base panel. A distal segmented tab extends from the base panel away from the right fold line. A plurality of substantially parallel fold lines traverses and subdivides the tab into plural segments. An elongated drawstrip joins the last tab segment most remote from the right fold line and extends between the back cover panel and the base panel through the central slot. Longitudinally movable from a retracted position substantially flattening the segmented tab to an extended position protruding through the central slot beyond the right fold line and curling the segmented tab under the base panel toward the slot. The individual separate pages are respectively secured to individual segments of the segmented tab and interleaved in staggered array protruding alternately toward opposite sides of the elongated drawstrip and the segmented tab, whereby progressive movement of the drawstrip from its retracted position towards its extended position causes progressive curling movement of the segmented tab, successively flipping over the individual staggered interleaved pages, while at all times displaying to view at least one full page and a substantial area of an underlying staggered page, thereby changing only part of the indicia displayed during each successive stage of the page-flipping operation.

U.S. Pat. No. 4,809,453 to Morgan discloses a invention relating to a folding card that displays one picture when closed and another picture when opened, comprising three hinged panels which form a front cover, a rear cover and an inside panel. Positioned partially in upper and lower channels formed by flanges hinged to the inside cover are a stationary picture unit and a movable picture unit. The picture units are each made of two subunits formed with slots and strips which are fitted together with the strips partially overlapping. The two picture units are mated together, and an extension of the moving picture unit is attached to the front cover. When the assembled picture card is in a closed position, the strips of the movable unit are displayed; when opened, the extension pulls the movable picture unit to the left causing its strips to smoothly slide behind the now displayed strips of the stationary unit as a result of the overlapping construction.

U.S. Pat. No. 6,246,461 to Hinsberg discloses an image positioning device including surface elements having front and back sides and images on the front and/or the back sides. An end of a first surface element and a front side of a second surface element are turnably coupled along a first axis of rotation and an end of the second surface element and a front side of a third surface element are turnably coupled along a second axis of rotation. The first and second rotational axes are approximately parallel with one another. Successive flipping of the surface elements animates the images.

United States Patent Application 2011/0047839 to Ross, et al. discloses a method for manufacturing a pop-up article from one or more continuous webs of material using an inline printing press. The article comprises a curved or generally semi-cylindrical pop-up device enclosed within a base piece, such that when the base piece is in a closed position, the pop-up device lies flat therein, but when the base piece is moved to an open position, the pop-up device is forced outwardly from the base piece to form a curved or generally semi-cylindrical shape. The method comprises processing a first web or ribbon to define a base piece having a front and back cover, processing a second web or ribbon to define a pop-up device, separating the pop-up device from the second web or ribbon, adhering a tab of the pop-up device to the front cover, adhering a front flap of the pop-up device to the rear cover, and separating the article from the first web or ribbon.

Although the aforementioned prior art have contributed to the development of the art of binding printed materials, none of these prior art patents have solved the needs of this art.

Another object of this invention is to provide an improved method for producing unique specialty printing pieces.

Therefore, it is an object of the present invention to provide an improved method for producing a fanning effect for multipage printed material.

Another object of this invention is to provide an improved method that provides a product that is cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved printed matter construction and method of making including a moving step article. The moving step article comprises an exterior cover having a hinge fold positioned between a front cover and a rear cover for pivoting the front cover between a closed position and an open position. The front cover has an obverse side and a reverse side. The rear cover has an obverse side and a reverse side. An interior leaf has an obverse side, a reverse side, an inner edge and an outer edge. The interior leaf defines a leaf width. A second interior leaf has an obverse side, a reverse side, an inner edge and an outer edge. The second interior leaf defines a second leaf width. The second leaf width has a greater width dimension than the leaf width. A spine sheet has an upper side, a lower side, an primary edge and an secondary edge. A primary hinge couples the primary edge of the spine sheet with the inner edge of the interior leaf. A secondary hinge couples the secondary edge of the spine sheet with the inner edge of the second interior leaf. The spine sheet, the interior leaf and the second interior leaf defines an integral one piece unit. A binder couples the lower side of the spine sheet with the reverse side of the front cover for defining a leaf offset dimension between the hinge fold and the inner edge of the interior leaf and a second leaf offset dimension between the hinge fold and the inner edge of the second interior leaf. The leaf offset causes the interior leaf to be displaced relative to the rear cover during pivoting the front cover between the closed position and the open position. The second leaf offset causes the second interior leaf to be displaced relative to the rear cover during pivoting the front cover between the closed position and the open position. The leaf offset dimension has a greater offset dimension than the second leaf offset dimension. The greater width dimension and the greater offset dimension create a step display tab area on the obverse side of the second interior leaf that is progressively revealed adjacent to the outer edge of the interior leaf during pivoting the front cover between the closed position and the open position.

In a more specific embodiment of the invention, a symbol is imprinted on the step display tab identifying a subject matter imprinted on the reverse side of the interior leaf and the obverse side of the second interior leaf.

In one embodiment of the invention, a back interior leaf has an obverse side, a reverse side, an inner edge and an outer edge. The back interior leaf defines a back leaf width. A back binder couples the inner edge of the back interior leaf with the obverse side of the rear cover for defining a back leaf offset dimension between the hinge fold and the inner edge of the back interior leaf. The back leaf offset causes the back interior leaf to be non-displaced relative to the rear cover during pivoting the front cover between the closed position and the open position. The back leaf offset creates a rear step display tab area on the obverse side of the back interior leaf that is progressively revealed adjacent to the outer edge of the second interior leaf during pivoting the front cover between the closed position and the open position.

The invention is also incorporated into the method of manufacturing a moving step article from a plurality of continuous ribbons of material using a line printing press. The method comprising the steps of inputting a first ribbon into the line printing press to define an obverse side of a front cover (A) and a reverse side of a rear cover (L) on a primary ribbon side and a reverse side of the front cover (B) and an obverse side of the rear cover (K) on a secondary ribbon side. A second ribbon is inputted into the line printing press to define a lower side of a spine sheet positioned between an obverse side of an interior leaf (C) and a reverse side of a second interior leaf (F) on a primary ribbon side and an upper side of the spine sheet positioned between a reverse side of the interior leaf (D) and an obverse side of the second interior leaf (E) on a secondary ribbon side. The second ribbon is perforated between the spine sheet and the interior leaf to define a primary hinge and a leaf width in the interior leaf. The second ribbon is folded between the spine sheet and the second interior leaf to define a secondary hinge and a second leaf width in the second interior leaf that is a greater width than the leaf width and positioning the reverse side of the interior leaf (D) adjacent to the obverse side of the second interior leaf (E). The lower side of the spine sheet is bound to the reverse side of the front cover (B) to define a step display tab area on the obverse side of the second interior leaf wherein the first ribbon is a non-folded position. The first ribbon is folded to define a hinge fold and positioning the interior leaf and the second interior leaf between the front cover and the rear cover. The first ribbon and the second ribbon is cut to length.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

FIGS. 1-10 illustrate a first embodiment of a moving step article 10. The moving step article 10 may be referred to as a book 12 providing various purposes, including but not limited to, advertising, fiction material, nonfiction material, artwork or other written materials. The moving step article is preferably constructed from a cellulose pulp material, however the construction may further include polymeric or other thin material that may receive writing, printing, or drawing.

Figure 1:
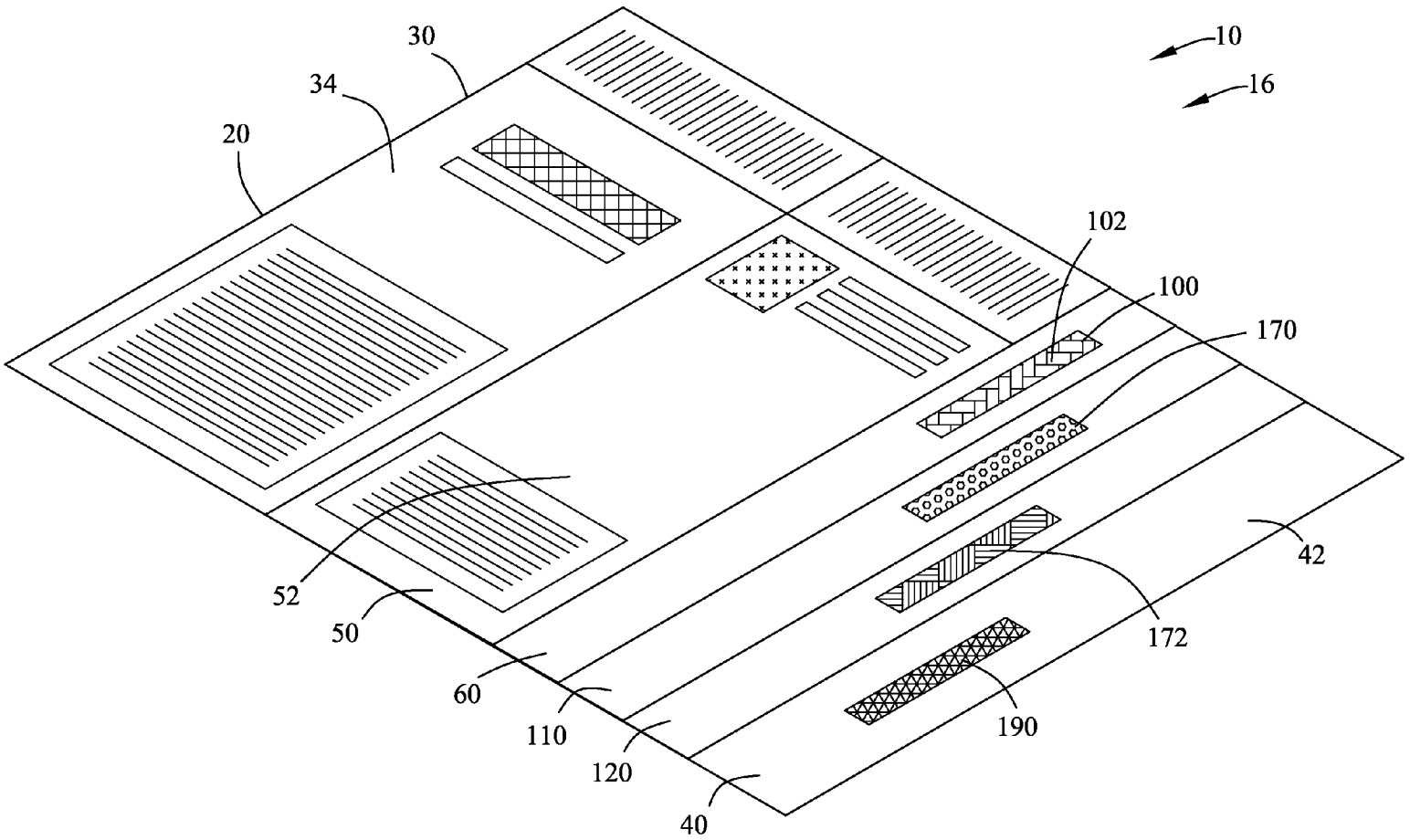
FIG. 1 is an isometric view of a first embodiment of a moving step article of the present invention in an open position.
Figure 2:
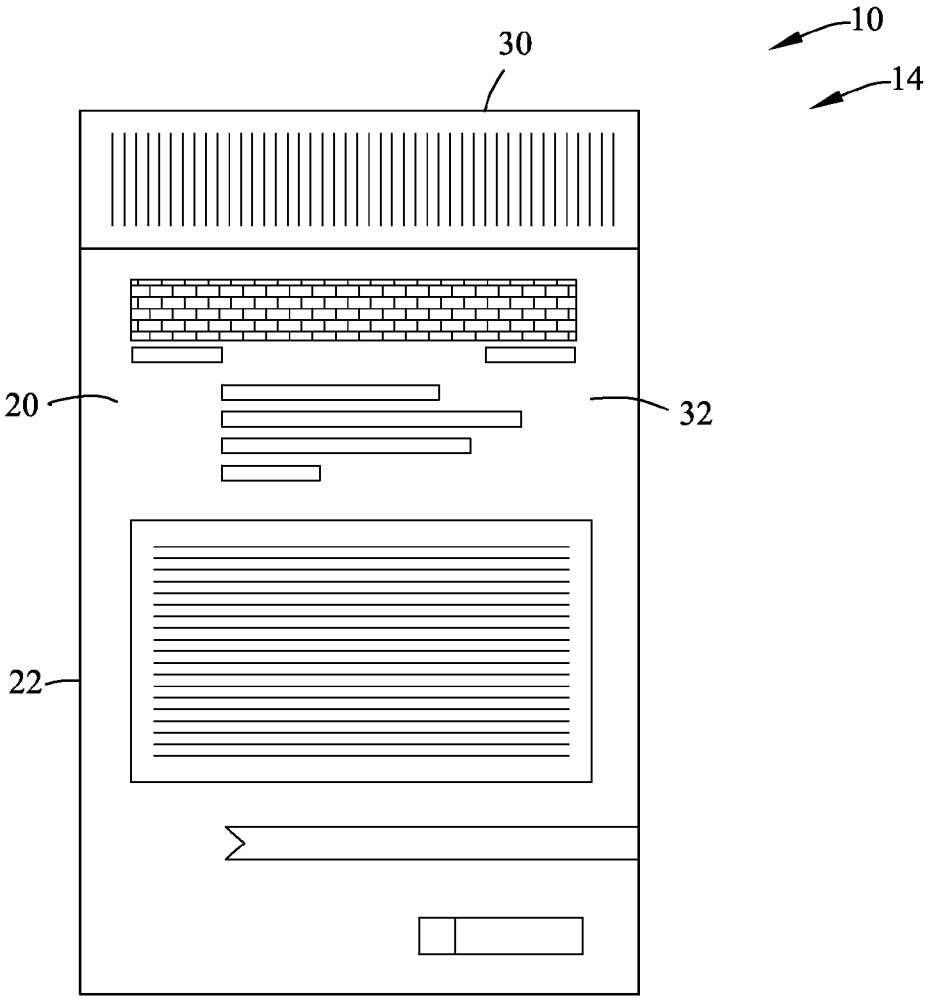
FIG. 2 is a top view of the moving step article in a closed position.
Figure 3:
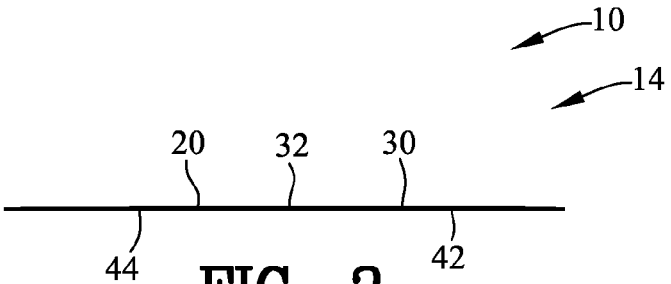
FIG. 3 is a bottom view of FIG. 2.
Figure 4:
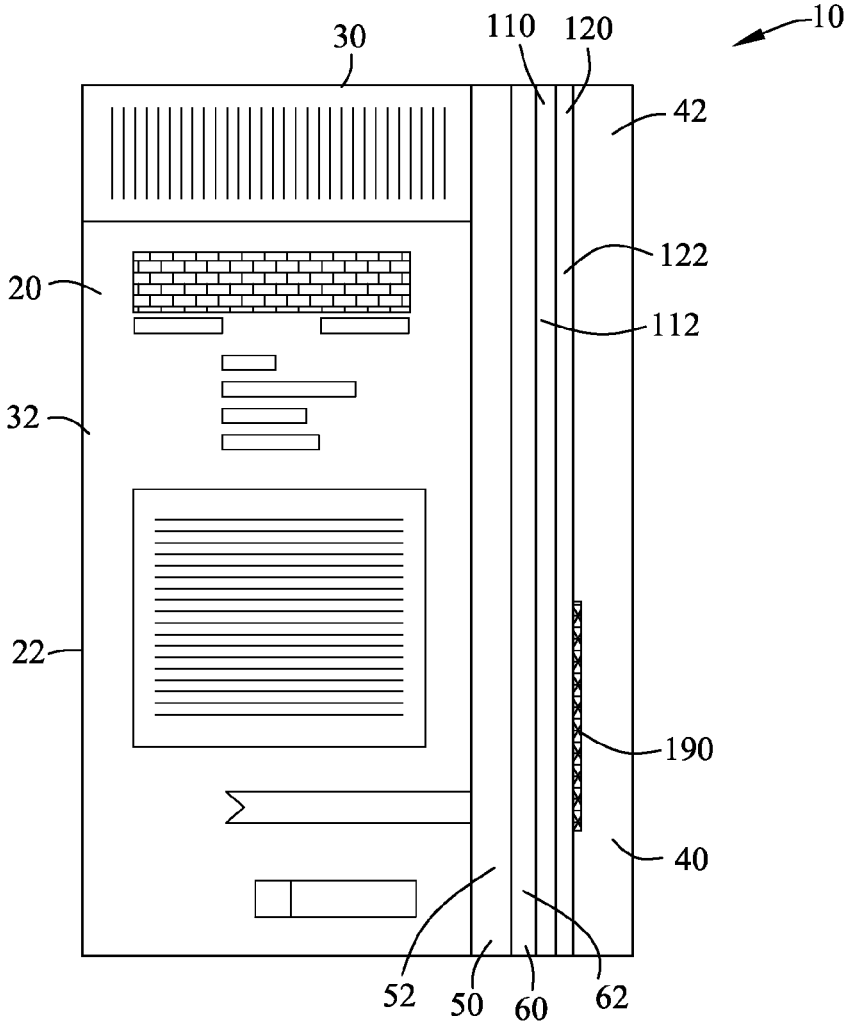
FIG. 4 is a top view similar to FIG. 2 illustrating a front cover of the moving step article in a first transitional position for placing the moving step article from the closed position into the open position.
Figure 5:
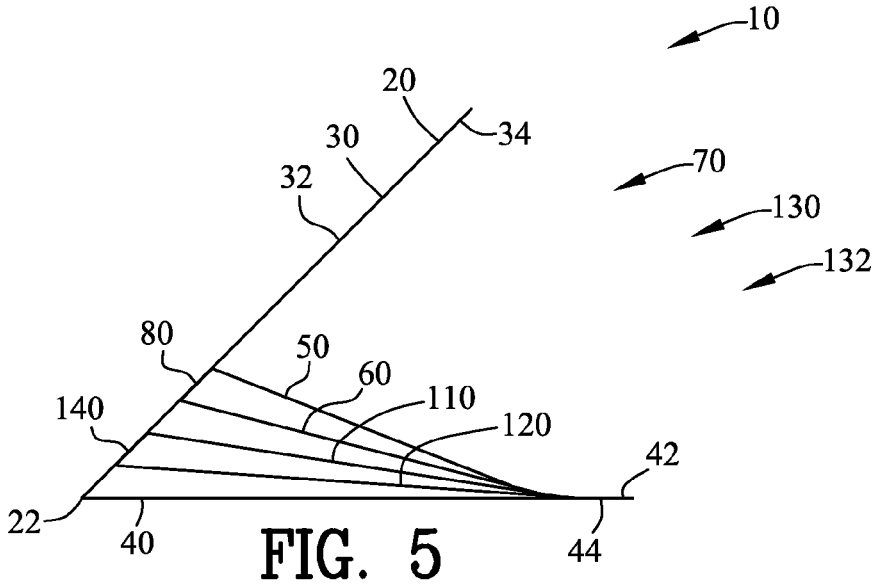
FIG. 5 is a bottom view of FIG. 4.
Figure 6:
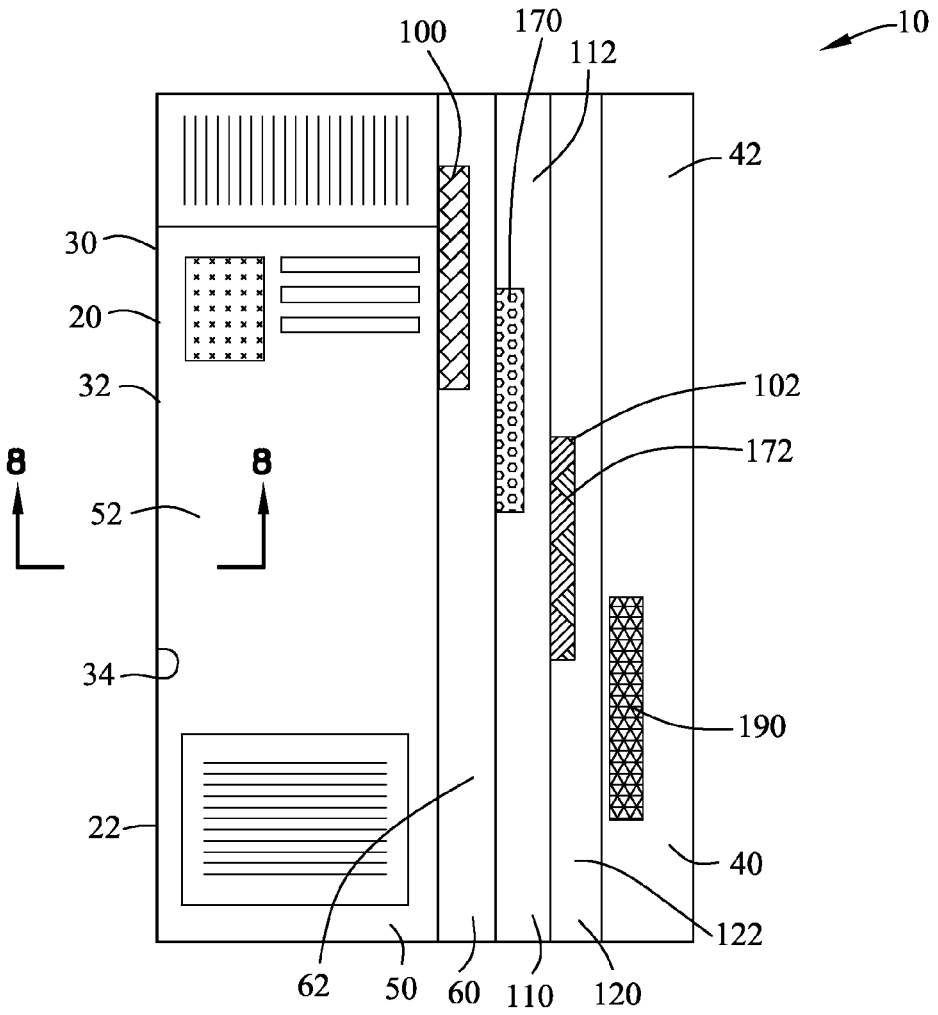
FIG. 6 is a top view similar to FIG. 4 illustrating a front cover of the moving step article in a second transitional position for placing the moving step article from the closed position into the open position.
Figure 7:
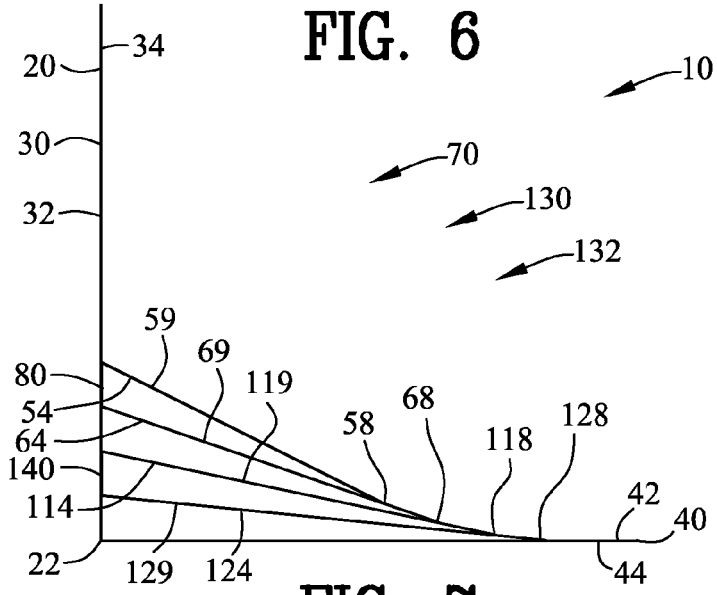
FIG. 7 is a bottom view of FIG. 6.
Figure 8:
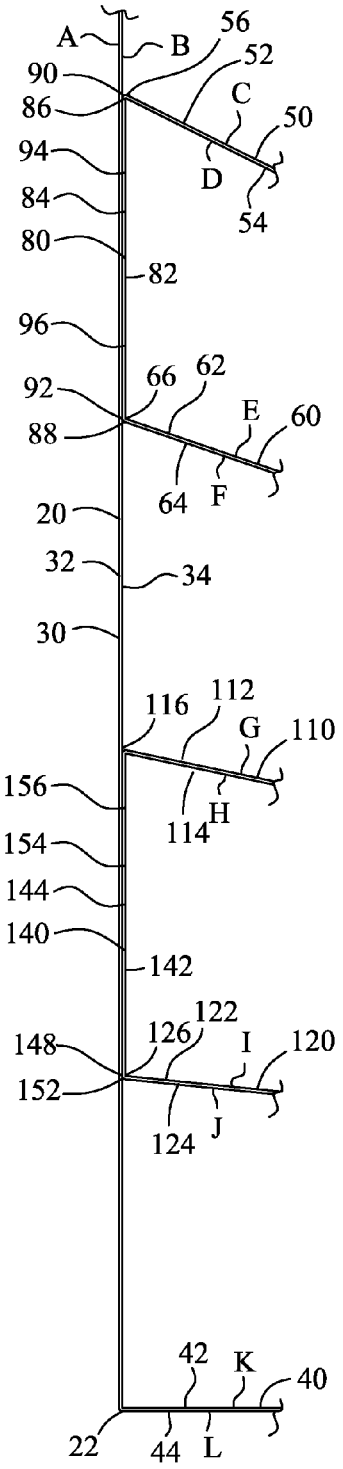
FIG. 8 is a sectional view along line 8-8 in FIG. 6.

The moving step article 10 comprises an exterior cover 20 having a hinge fold 22 positioned between a front cover 30 and a rear cover 40 for pivoting the front cover 30 between a closed position 14 as shown in FIGS. 2 and 3 and an open position 16 as shown in FIG. 1. The front cover 30 has an obverse side 32 and a reverse side 34. The rear cover 40 has an obverse side 42 and a reverse side 44.

An interior leaf 50 has an obverse side 52, a reverse side 54, an inner edge 56 and an outer edge 58. The interior leaf 50 defines a leaf width 59. A second interior leaf 60 has an obverse side 62, a reverse side 64, an inner edge 66 and an outer edge 68. The second interior leaf 60 defines a second leaf width 69. The second leaf width 69 has a greater width dimension 70 than the leaf width 59.

Figure 9:
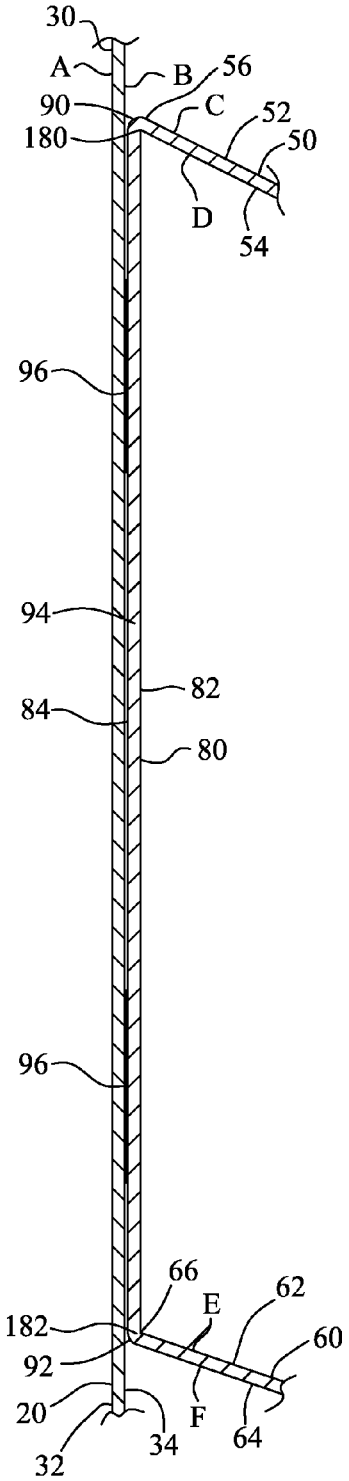
FIG. 9 is a magnified view of an upper portion of FIG. 8 illustrating a spine sheet linked with an interior leaf with a second interior leaf wherein a binder couples the spine sheet to the reverse side of the front cover.
Figure 10:
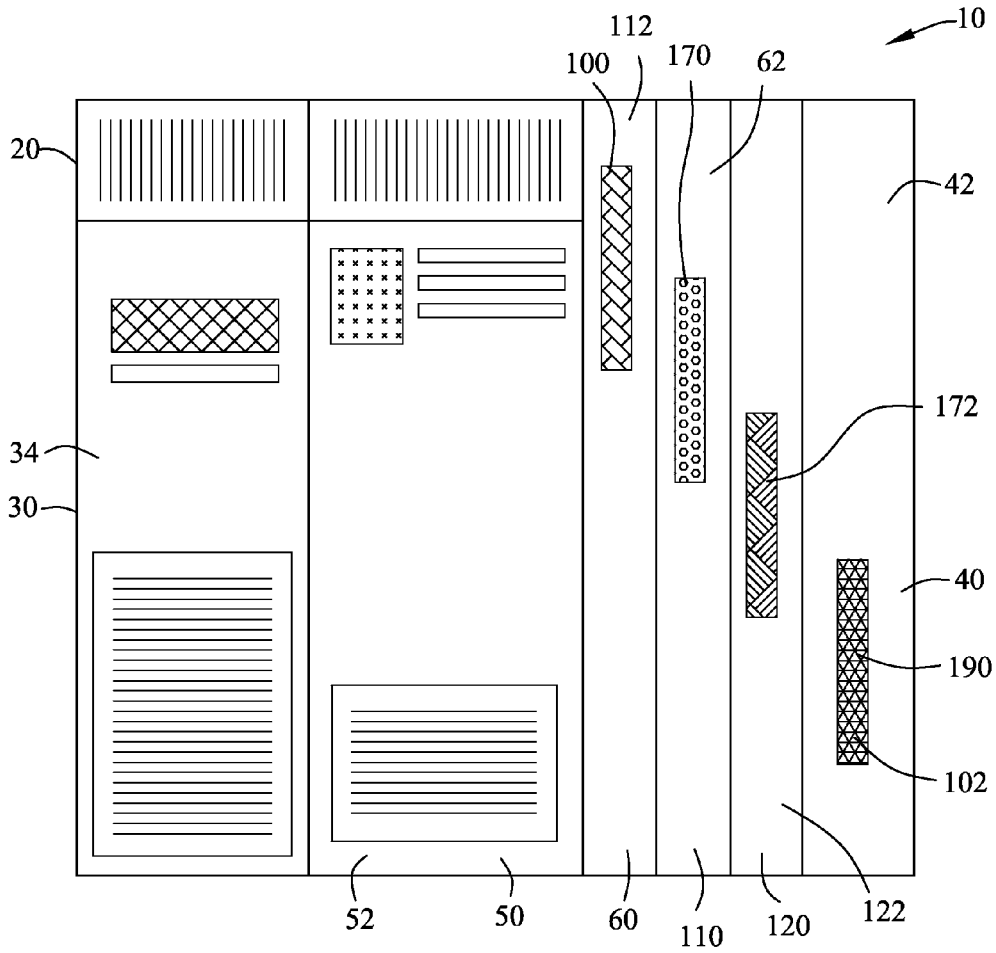
FIG. 10 is a top view similar to FIG. 6 illustrating a front cover of the moving step article in a third transitional position for placing the moving step article from the closed position into the open position.
Figure 11:
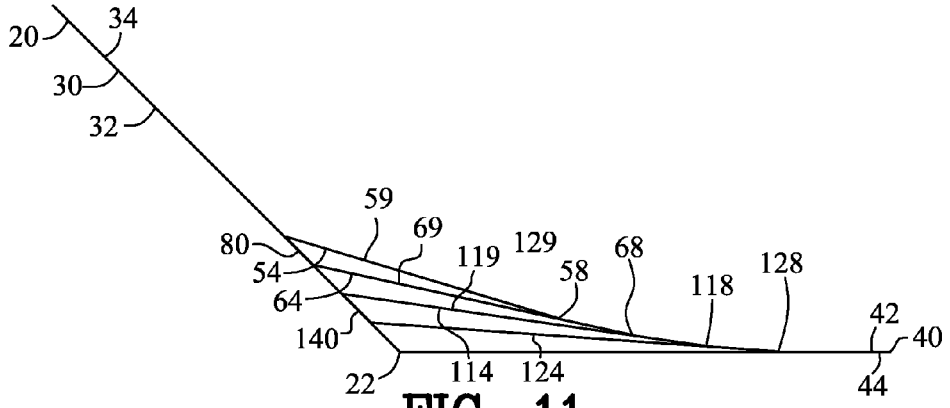
FIG. 11 is a bottom view of FIG. 10.

A spine sheet 80 has an upper side 82, a lower side 84, a primary edge 86 and a secondary edge 88. A primary hinge 90 couples the primary edge 86 of the spine sheet 80 with the inner edge 56 of the interior leaf 50. A secondary hinge 92 couples the secondary edge 88 of the spine sheet 80 with the inner edge 66 of the second interior leaf 60. The spine sheet 80, the interior leaf 50 and the second interior leaf 60 define an integral one piece unit 94. As best shown in FIG. 9, a binder 96 couples the lower side 84 of the spine sheet 80 with the reverse side 34 of the front cover 30 for defining a leaf offset dimension 98 between the hinge fold 22 and the inner edge 56 of the interior leaf 50 and a second leaf offset dimension 99 between the hinge fold 22 and the inner edge 66 of the second interior leaf 60. The leaf offset 98 causes the interior leaf 50 to be displaced relative to the rear cover 40 during pivoting the front cover 30 between the closed position 14 and the open position 16. The second leaf offset 99 causes the second interior leaf 60 to be displaced relative to the rear cover 40 during pivoting the front cover 30 between the closed position 14 and the open position 16. The leaf offset dimension 98 has a greater offset dimension 72 that the second leaf offset dimension 99. The greater width dimension 70 and the greater offset dimension 72 create a step display tab area 100 on the obverse side 62 of the second interior leaf 60 that is progressively revealed adjacent to the outer edge 58 of the interior leaf 50 during pivoting the front cover 30 between the closed position 14 and the open position 16. A symbol 102 may be imprinted on the step display tab 100 identifying a subject matter imprinted on the reverse side 54 of the interior leaf 50 and the obverse side 62 of the second interior leaf 60. The symbol 102 may include but not limited to numbers, letters, colors, patterns, textures or other matter.

A third interior leaf 110 has an obverse side 112, a reverse side 114, an inner edge 116 and an outer edge 118. The third interior leaf 110 defines a third leaf width 119. A fourth interior leaf 120 has an obverse side 122, a reverse side 124, an inner edge 126 and an outer edge 128. The fourth interior leaf 120 defines a fourth leaf width 129. The third leaf width 119 has a second greater width dimension 130 than the second leaf width 69. The fourth leaf width 129 has a third greater width dimension 132 than the third leaf width 119.

A second spine sheet 140 has an upper side 142, a lower side 144, an primary edge 146 and an secondary edge 148. A primary hinge 150 couples the primary edge 146 of the second spine sheet 140 with the inner edge 116 of the third interior leaf 110. A secondary hinge 152 couples the secondary edge 148 of the second spine sheet 140 with the inner edge 126 of the fourth interior leaf 120. The second spine sheet 140, the third interior leaf 110 and the fourth interior leaf 120 define an integral one piece unit 154. As best shown in FIG. 9, a second binder 156 couples the lower side 144 of the second spine sheet 140 with the reverse side 34 of the front cover 30 for defining a third leaf offset dimension 158 between the hinge fold 22 and the inner edge 116 of the third interior leaf 110 and a fourth leaf offset dimension 159 between the hinge fold 22 and the inner edge 126 of the fourth interior leaf 120.

The third leaf offset 158 causes the third interior leaf 110 to be displaced relative to the rear cover 40 during pivoting the front cover 30 between the closed position 14 and the open position 16. The fourth leaf offset 159 causes the fourth interior leaf 120 to be displaced relative to the rear cover 40 during pivoting the front cover 30 between the closed position 14 and the open position 16. The second leaf offset dimension 99 has a second greater offset dimension 160 than the third leaf offset dimension 158. The third leaf offset dimension 158 had a third greater offset dimension 162 than the fourth leaf offset dimension 159. The second greater width dimension 130 and the second greater offset dimension 160 create a second step display tab area 170 on the obverse side 112 of the third interior leaf 110 that is progressively revealed adjacent to the outer edge 68 of the second interior leaf 60 during pivoting the front cover 30 between the closed position 14 and the open position 16. The third greater width dimension 132 and the third greater offset dimension 162 create a third step display tab area 172 on the obverse side 122 of the fourth interior leaf 120 that is progressively revealed adjacent to the outer edge 118 of the third interior leaf 110 during pivoting the front cover 30 between the closed position 14 and the open position 16.

Preferably, the primary hinges 90 and 150 include a primary linear perforation 180 for promoting the interior leaf 50 to maintain a parallel orientation relative to the exterior cover 20 during the open position 16. The secondary hinge 92 includes a secondary linear perforation 182 for promoting the second interior leaf 60 to maintain a parallel orientation relative to the exterior cover 20 during the open position 16. Similarly, the primary hinge 150 include a primary linear perforation 180 for promoting the third interior leaf 110 to maintain a parallel orientation relative to the exterior cover 20 during the open position 16. The secondary hinge 152 includes a secondary linear perforation 182 for promoting the fourth interior leaf 60 to maintain a parallel orientation relative to the exterior cover 20 during the open position 16.

As best shown in FIGS. 1 and 4-7, the obverse side 42 of the rear cover 40 includes a back display tab area 190 that is progressively revealed adjacent to the outer edge 68 of the second interior leaf 60 if only the interior leaf 50 and the second interior leaf 60 are utilized or adjacent to the outer edge 128 of the fourth interior leaf 120 during pivoting the front cover 30 between the closed position 14 and the open position 16.

As shown in FIGS. 29-35, the moving step article 10 may further include a back interior leaf 200 having an obverse side 202, a reverse side 204, an inner edge 206 and an outer edge 208. The back interior leaf 200 defines a back leaf width 209. A back binder 210 couples the inner edge 206 of the back interior leaf 200 with the obverse side 42 of the rear cover 40 for defining a back leaf offset dimension 212 between the hinge fold 22 and the inner edge 206 of the back interior leaf 200. The back leaf offset 212 causes the back interior leaf 200 to be non-displaced relative to the rear cover 40 during pivoting the front cover 30 between the closed position 14 and the open position 16. The back leaf offset 212 creates a rear step display tab area 214 on the obverse side 202 of the back interior leaf 200 that is progressively revealed adjacent to the outer edge 68 of the second interior leaf 60 if only the interior leaf 50 and the second interior leaf 60 are utilized or adjacent to the outer edge 128 of the fourth interior leaf 120 during pivoting the front cover 30 between the closed position 14 and the open position 16.

Figure 12:
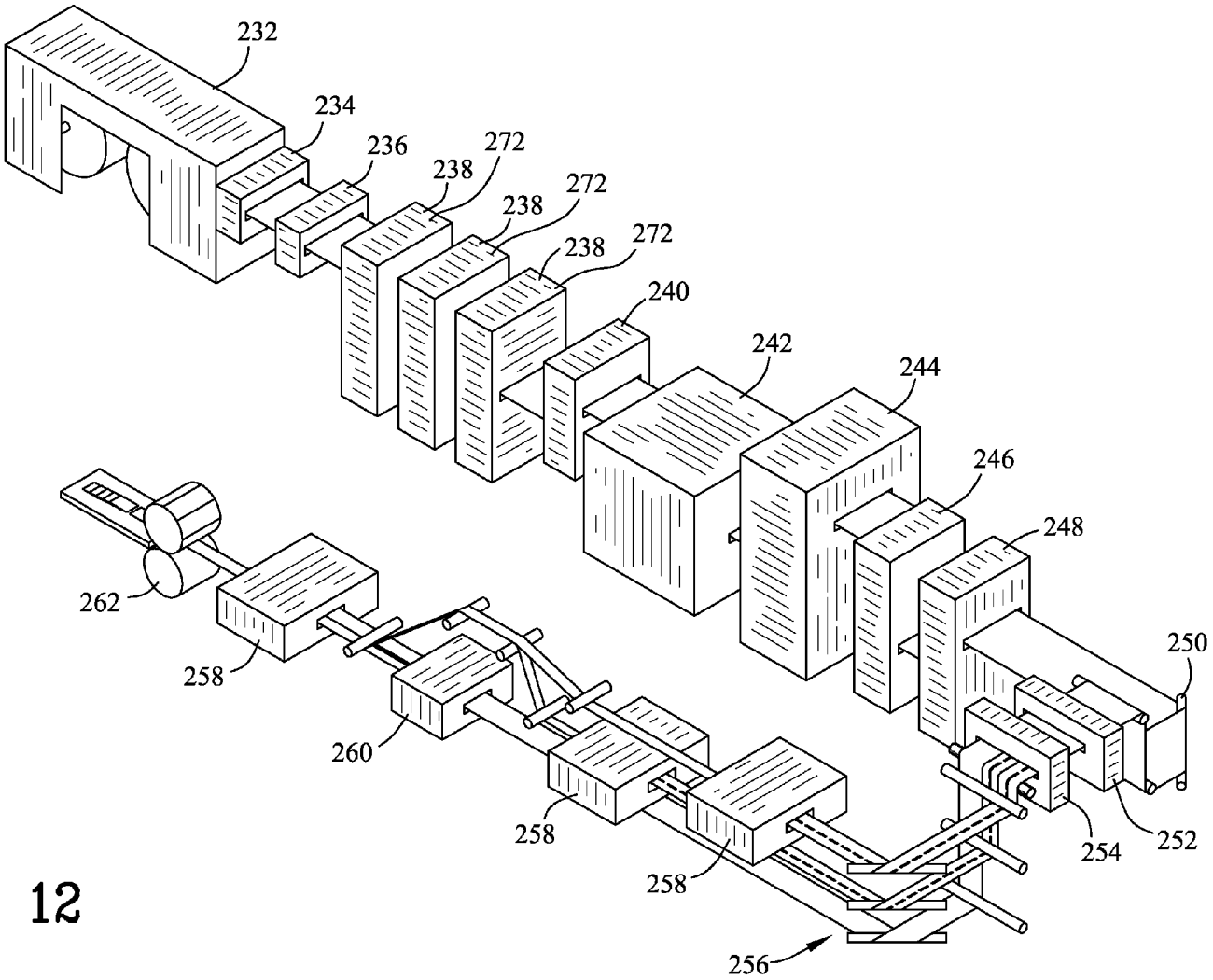
FIG. 12 is an isometric view of a line printing press for manufacturing the moving step article from a continuous ribbon of material.
Figure 13:
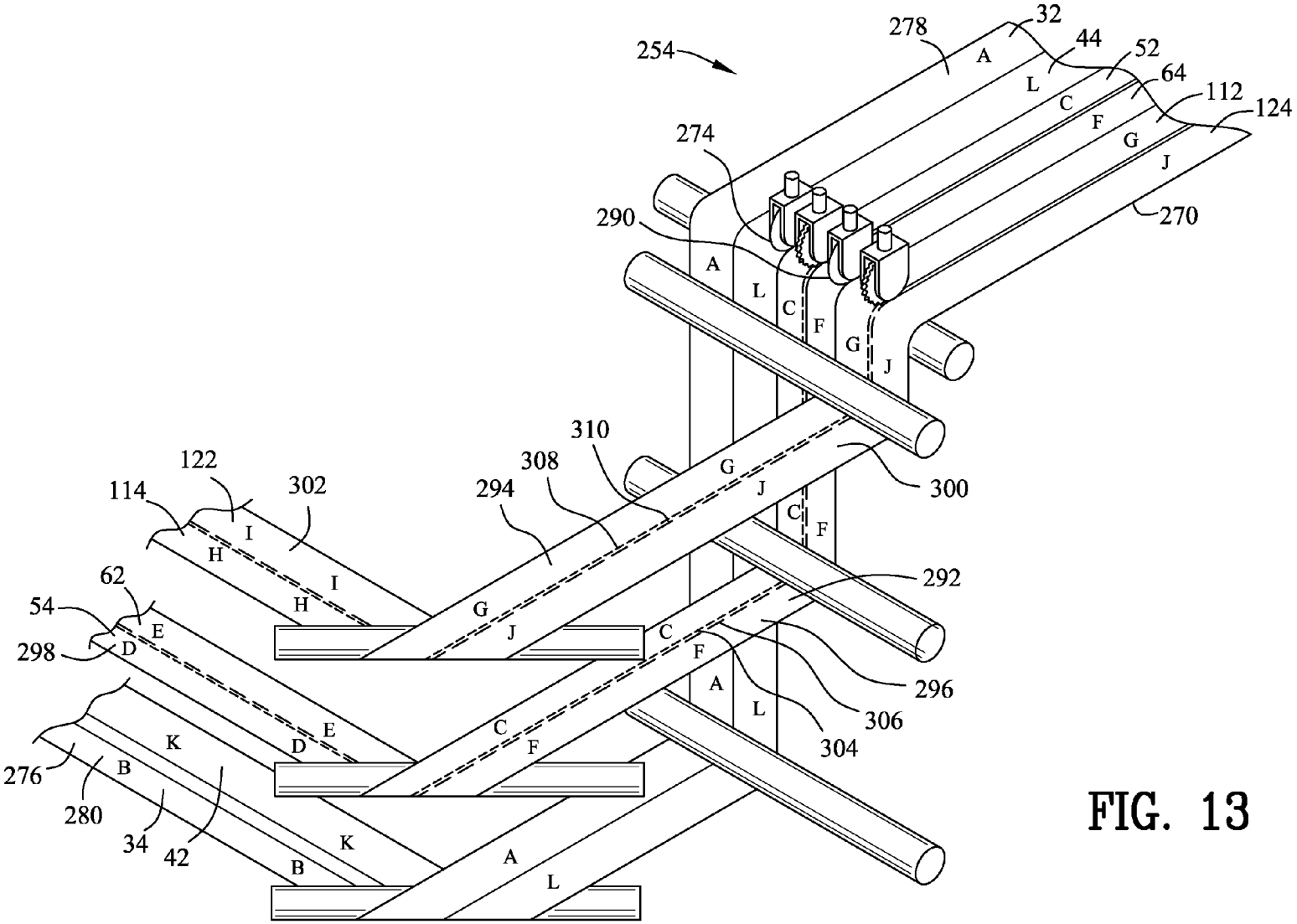
FIG. 13 is an isometric view of a portion of the line printing press of FIG. 12 illustrating a first method for manufacturing a moving step article including a plurality of ribbon decks for cutting the continuous ribbon of material into multiple ribbons, perforating a plurality of perforations into the second ribbon and the third ribbon and for realigning the plurality of multiple ribbons.
Figure 14:
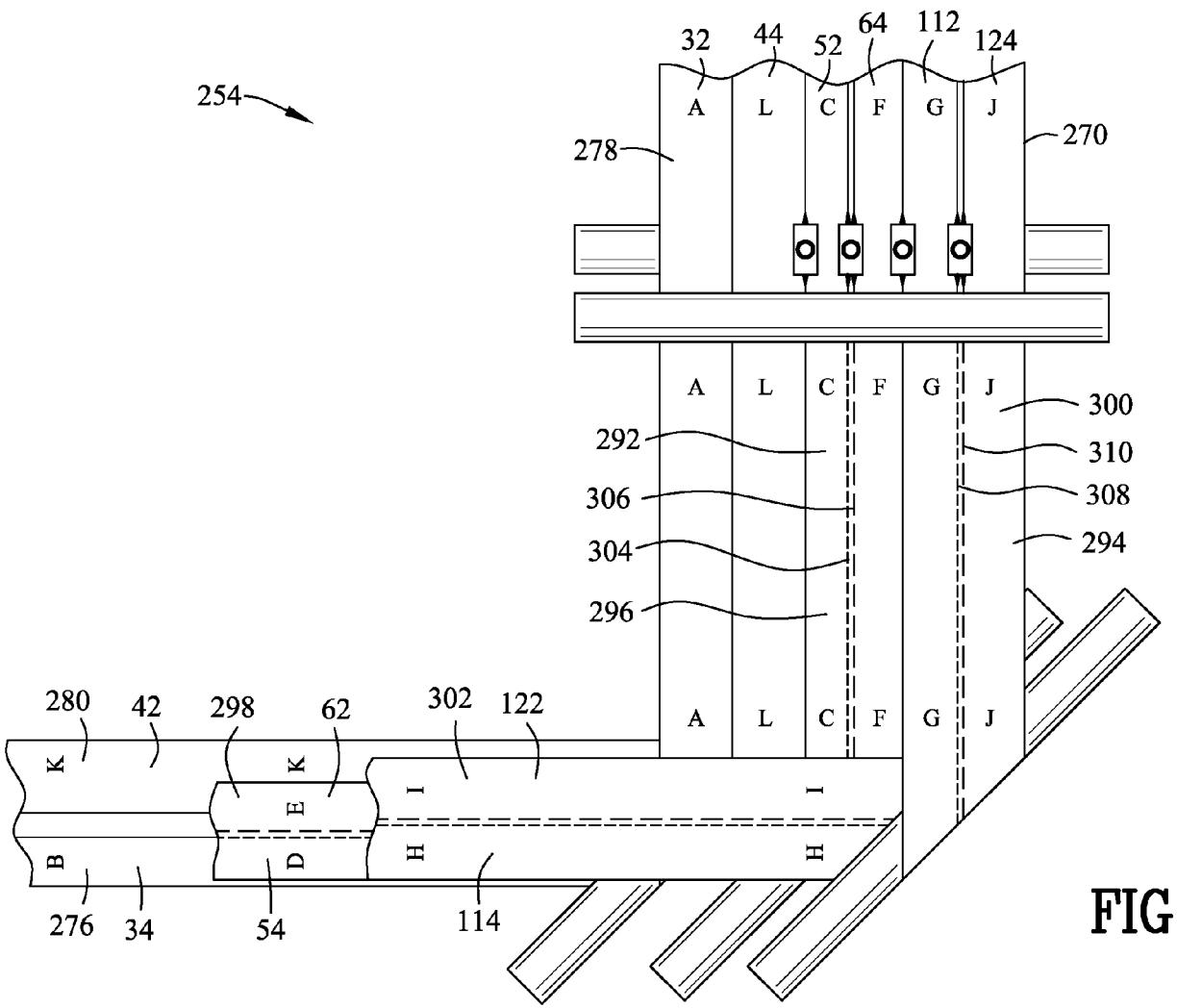
FIG. 14 is a top view of FIG. 13 illustrating a plurality ribbons realigned.

The subject invention further incorporates the method of manufacturing the moving step article 10. FIG. 12 illustrates a line printing press 230 utilized for manufacturing the moving step article 10. As shown in FIG. 12, the line printing press 230 includes a splicer unit 232 that allows continuous feed of paper into the printing units/press, by running one roll to completion and switching over to the second roll without stopping. A tension in-feed unit 234 is used to maintain tension throughout the press and plays a key role in print quality. The tension may vary depending on the formats and paper. A web guide(s) unit 236 keeps web centered throughout the press, depending on the press configuration there can be multiple web guides. A print unit(s) 238 transfer images to both sides of the paper simultaneously. A pattern glue unit 240 applies finely metered glue, coating solution on scratch of coatings to web. The units include, 360° motorized circumferential register and are available in various configurations. A oven unit 242 is used to dry ink, glues and other specialty coatings.

A chills unit 244 includes large rollers with chilled water circulating through them to cool the web and "set" the ink. A pattern perf unit 246 applies perforations to the web using litho perf tape. The plate cylinders are customized to use same plates as the press. Features include 360° motorized circumferential register as well as on-the-run depth-of-perf adjustment. A ink jet tower unit 248 applies variable data to the web as it passes under the 4.25 inch heads and dried via the IR lights. A 90 degree turn bar unit 250 is used to turn the web towards the in line portion of the press. A die cutter unit 252 may be utilized for use with etched steel plate dies mounted on a magnetic plate cylinder. The unit includes cylinder. The unit includes cylinders mounted in preloaded tapered roller bearings with precise adjustment of pressure between cylinders in increments of 0.0001". A ribbon deck(s) unit 254 are custom configured to slit web into multiple ribbons and realign the ribbons including the ability to reverse ribbons. Motorized movement of angle bars and compensators with position indicators for each enable quick make ready. A seam gluer unit 256 may be used to apply glues, scratch off coatings, encapsulated fragrance and UV Coatings.

A plurality of Plow folding stations 258 are used for making running folds in the web or ribbons. Plow Stations contain two rotary plow shoes, mounted on cross slide with horizontal and vertical movement. Each station contains a driven pull roller with nip wheels and two movable roller assemblies, one before and one after the plow. These rollers are easily movable by a hand-wheel and enable quick set up of the plow fold geometry. A hot melt glue application(s) 260 apply either permanent glue or fugitive glue. A rotary cutter unit 262 enables cutting and bleed trimming folded products. Rotary cutters permit the creation of rounded edges, sculpted edges and contour cuts. Each of the plow folding stations 258 may include a banana roller 264, a roller shoe 266 and a brush shoe 268.

FIGS. 12-22 illustrate the method utilized for manufacturing the moving step article 10 as shown in FIGS. 1-1. A continuous ribbon of material 270 is inputted into the line printing press 230. Images 272 are imprinted on the continuous ribbon 270 as the continuous ribbon to 70 travels through the print units 238. As the continuous ribbon 270 travels through the die cutter unit 252, a first separation split 274 into the continuous ribbon 270 to define a first ribbon 276 having an obverse side 32 of a front cover 30 (A) and a reverse side 44 of a rear cover 40 (L) on a primary ribbon side 278 and a reverse side 34 of the front cover 30 (B) and an obverse side 42 of the rear cover 40 (K) on a secondary ribbon side 280.

A further cut includes a second separation split 290 into the continuous ribbon to define a second ribbon 292 and a third ribbon 294. The second ribbon 292 has the lower side 84 of a spine sheet 80 positioned between an obverse side 52 of an interior leaf 50(C) and a reverse side 64 of a second interior leaf 60(F) on a primary ribbon side 296 and an upper side 82 of the spine sheet 80 positioned between a reverse side 54 of the interior leaf 50 (D) and an obverse side 62 of the second interior leaf 60 (E) on a secondary ribbon side 298.

The third ribbon 294 has a lower side 144 of a second spine sheet 140 positioned between an obverse side 112 of an third interior leaf 110 (G) and a reverse side 124 of a fourth interior leaf 120 (J) on a primary ribbon side 300 and an upper side 142 of the second spine sheet 140 positioned between a reverse side 114 of the third interior leaf 110 (H) and an obverse side 122 of the fourth interior leaf 120 (I) on a secondary ribbon side 302.

A first perforation 304 is perforated into the second ribbon 292 between the spine sheet 80 and the interior leaf 50 to define a primary hinge 90 and a leaf width 59 in the interior leaf 50. A second perforation 306 is perforated into the second ribbon 292 between the spine sheet 80 and the second interior leaf 60 to define a secondary hinge 92 and a second leaf width 69 in the second interior leaf 60. A third perforation 308 is perforated into the third ribbon 294 between the second spine sheet 140 and the third interior leaf 110 to define a primary hinge 150 and a third leaf width 119 in the third interior leaf 110. A fourth perforation 310 is perforated into the third ribbon 294 between the second spine sheet 140 and the fourth interior leaf 120 to define a secondary hinge 152 and a fourth leaf width 129 in the fourth interior leaf 120.

Figure 15:
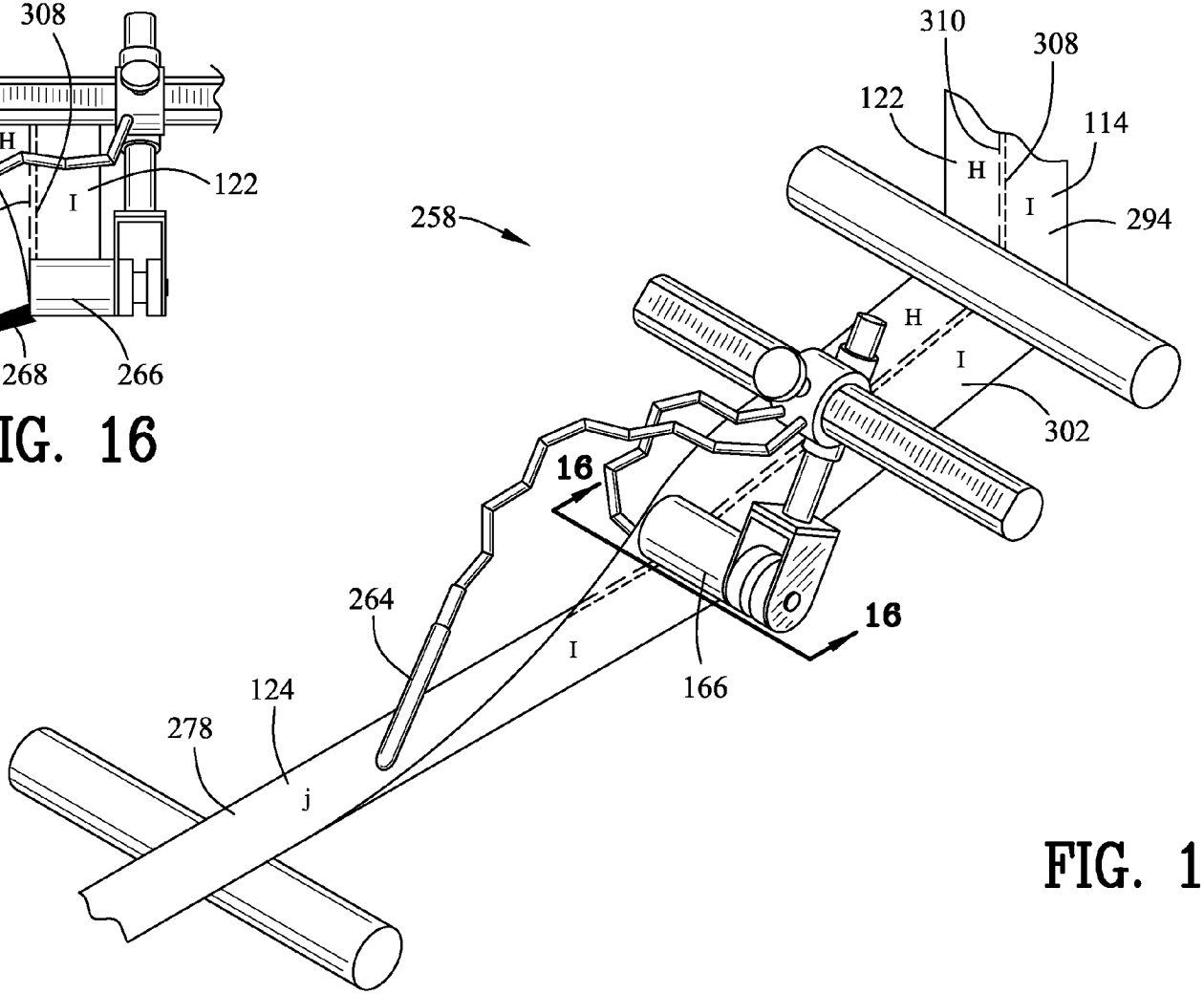
FIG. 15 is an isometric view of a third ribbon entering a third plow folding station for folding the third ribbon between the second spine sheet and the fourth interior leaf to define the secondary hinge and the fourth leaf width in the fourth interior leaf that is a greater width than the third leaf width and positioning the reverse side of the third interior leaf (H) adjacent to the obverse side of the fourth interior leaf (I)
Figure 16:
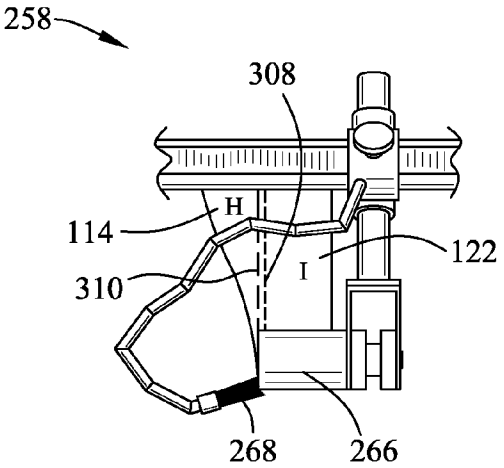
FIG. 16 is a top view of FIG. 15.
Figures 17, 18:
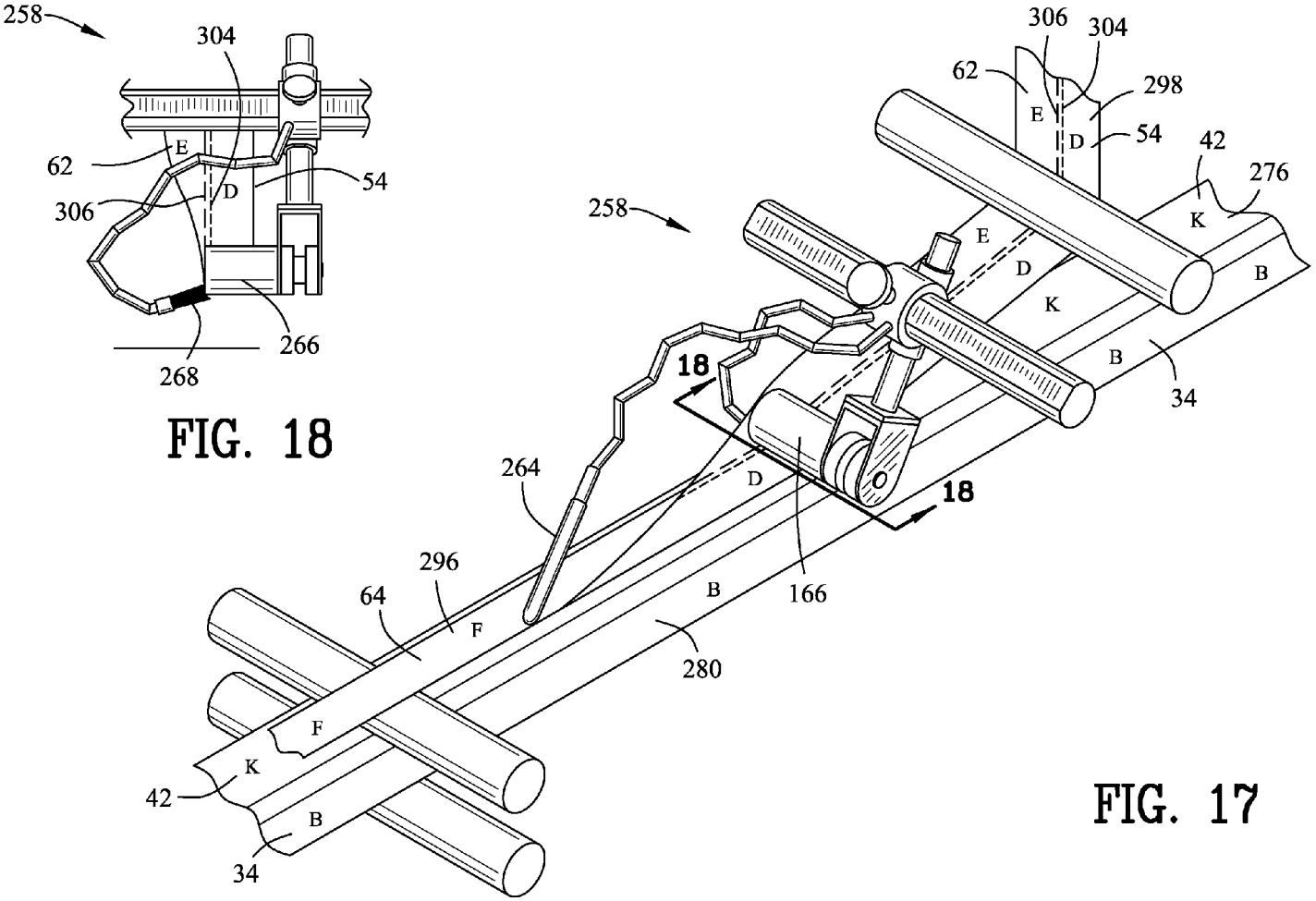
FIG. 17 is an isometric view of a second ribbon entering a second plow folding station for folding the second ribbon folding between the spine sheet and the second interior leaf to define the secondary hinge and the second leaf width in the second interior leaf that is a greater width than the leaf width and positioning the reverse side of the interior leaf (D) adjacent to the obverse side of the second interior leaf (E)
FIG. 18 is a top view of FIG. 17.
Figure 19:
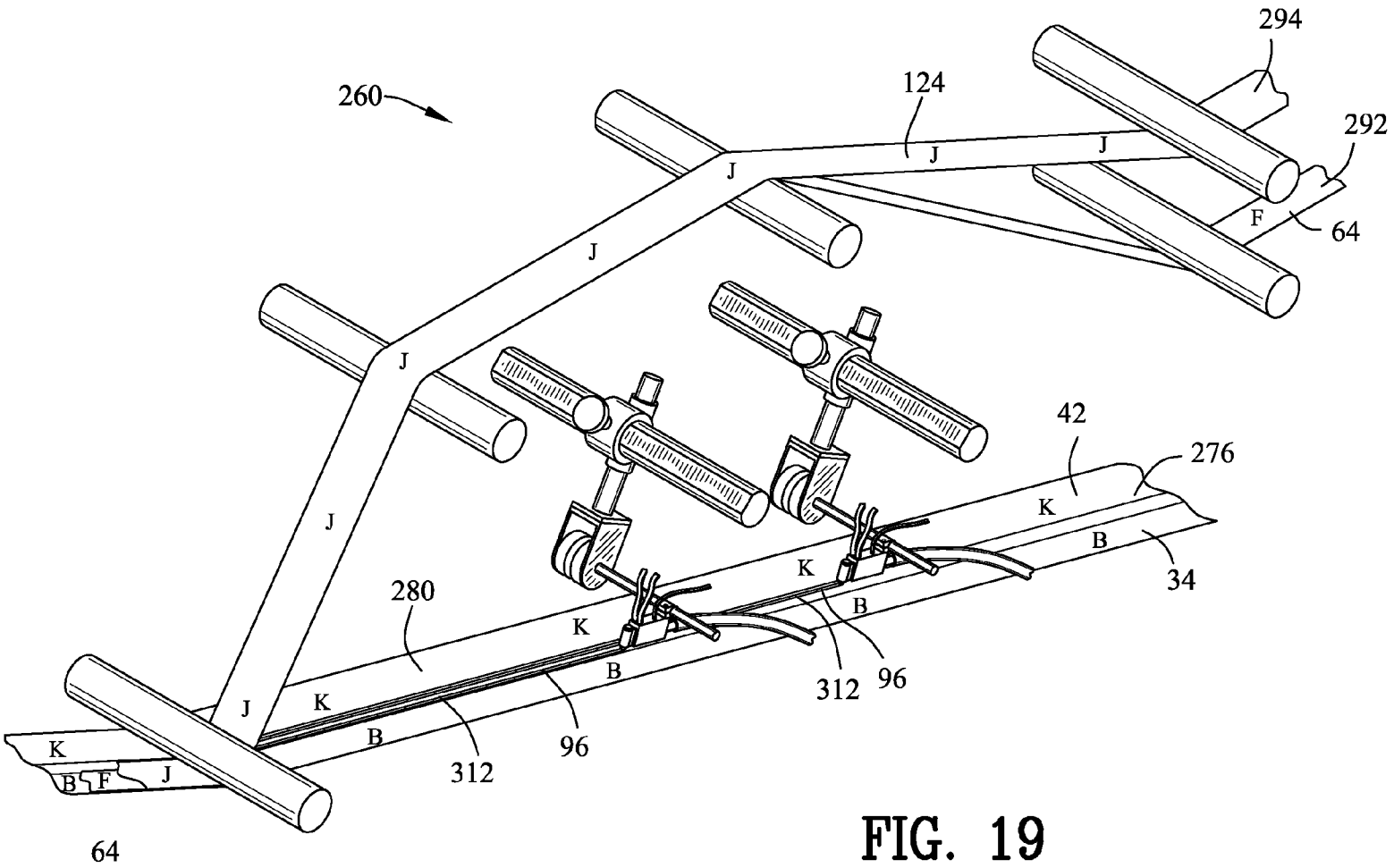
FIG. 19 is an isometric view of a hot melt glue applicator station applying glue to a first ribbon and thereafter binding the lower side of the spine sheet to the reverse side of the front cover (B) to define a step display tab area on the obverse side of the second interior leaf wherein the first ribbon is a non-folded position and binding the lower side of the second spine sheet to the reverse side of the front cover (B) to define a second step display tab area on the obverse side of the third interior leaf (G) and a third step display tab area on the obverse side of the fourth interior leaf (I) wherein the first ribbon is a non-folded position.

As shown in FIGS. 17 and 18, the second ribbon 292 is folded between the spine sheet 80 and the second interior leaf 60 to define the secondary hinge 92 and the second leaf width 69 in the second interior leaf 60 that is a greater width than the leaf width 59 and positioning the reverse side 54 of the interior leaf 50 (D) adjacent to the obverse side 62 of the second interior leaf 60 (E);

As shown in FIGS. 15 and 16, the third ribbon 294 is folded between the second spine sheet 140 and the fourth interior leaf 120 to define the secondary hinge 152 and the fourth leaf width 129 in the fourth interior leaf 120 that is a greater width than the third leaf width 119 and positioning the reverse side 114 of the third interior leaf 110 (H) adjacent to the obverse side 122 of the fourth interior leaf 120 (I);

As shown in FIG. 19 the lower side 84 of the spine sheet 80 is bound to the reverse side 34 of the front cover 30 (B) by a line of binder 96 to define the step display tab area 100 on the obverse side 62 of the second interior leaf 60 wherein the first ribbon 276 is in a non-folded position. The lower side 144 of the second spine sheet 140 is simultaneously bound to the reverse side 34 of the front cover 30 (B) by an addition line of binder 96 to define a second step display tab area 170 on the obverse side 112 of the third interior leaf 110 (G) and a third step display tab area 172 on the obverse side 122 of the fourth interior leaf 120 (I) wherein the first ribbon 276 is a non-folded position.

Figure 20:
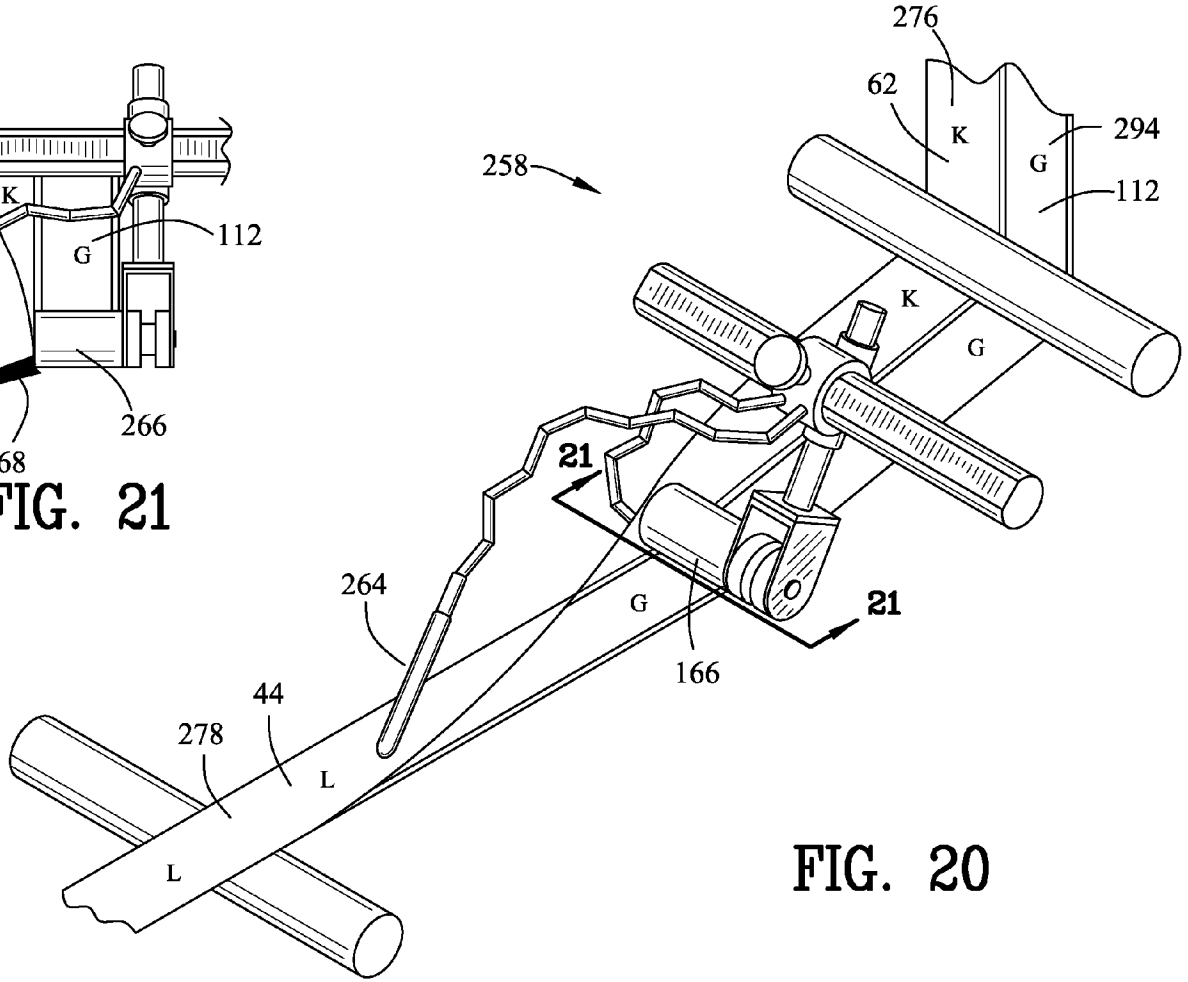
FIG. 20 is an isometric view of the first ribbon, the second ribbon and the third ribbon entering a first plow folding station for folding the first ribbon to define a hinge fold and positioning the interior leaf, the second interior leaf, the third interior leaf and the fourth interior leaf between the front cover and the rear cover.
Figure 21:
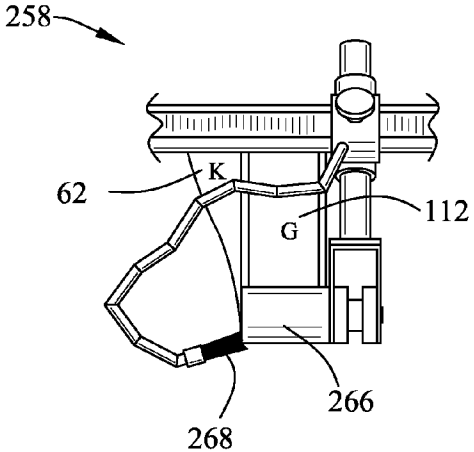
FIG. 21 is a top view of FIG. 20.
Figure 22:
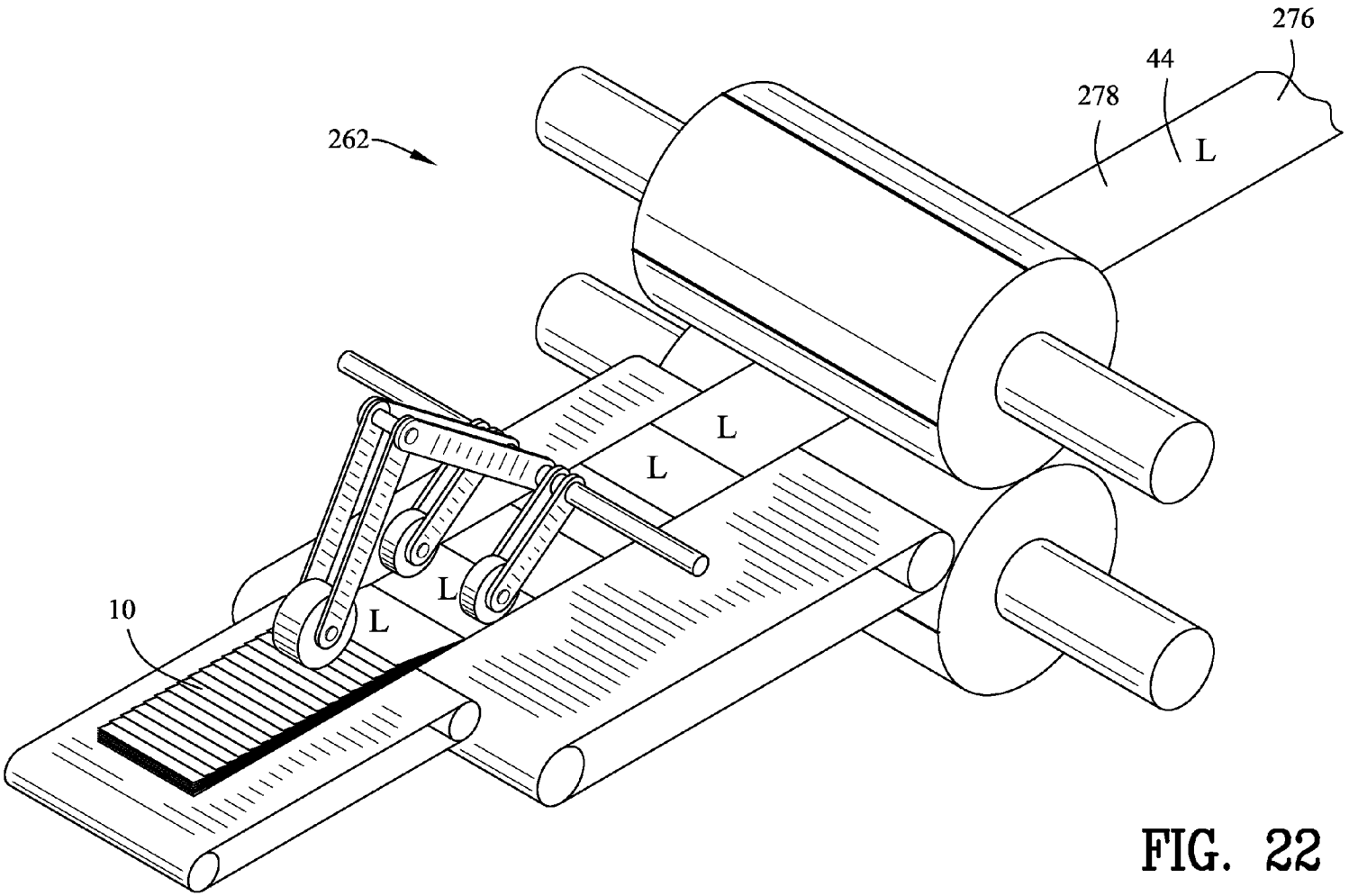
FIG. 22 is an isometric view of a rotary cutter station for cutting the first ribbon, the second ribbon and the third ribbon to length.

As shown in FIGS. 20 and 21, the first ribbon 276 is folding to define the hinge fold 22 and positioning the interior leaf 50, the second interior leaf 60, the third interior leaf 110 and the fourth interior leaf 120 between the front cover 30 and the rear cover 40. FIG. 22 illustrates the first ribbon, the second ribbon and the third ribbon being cut to length.

Figure 34:
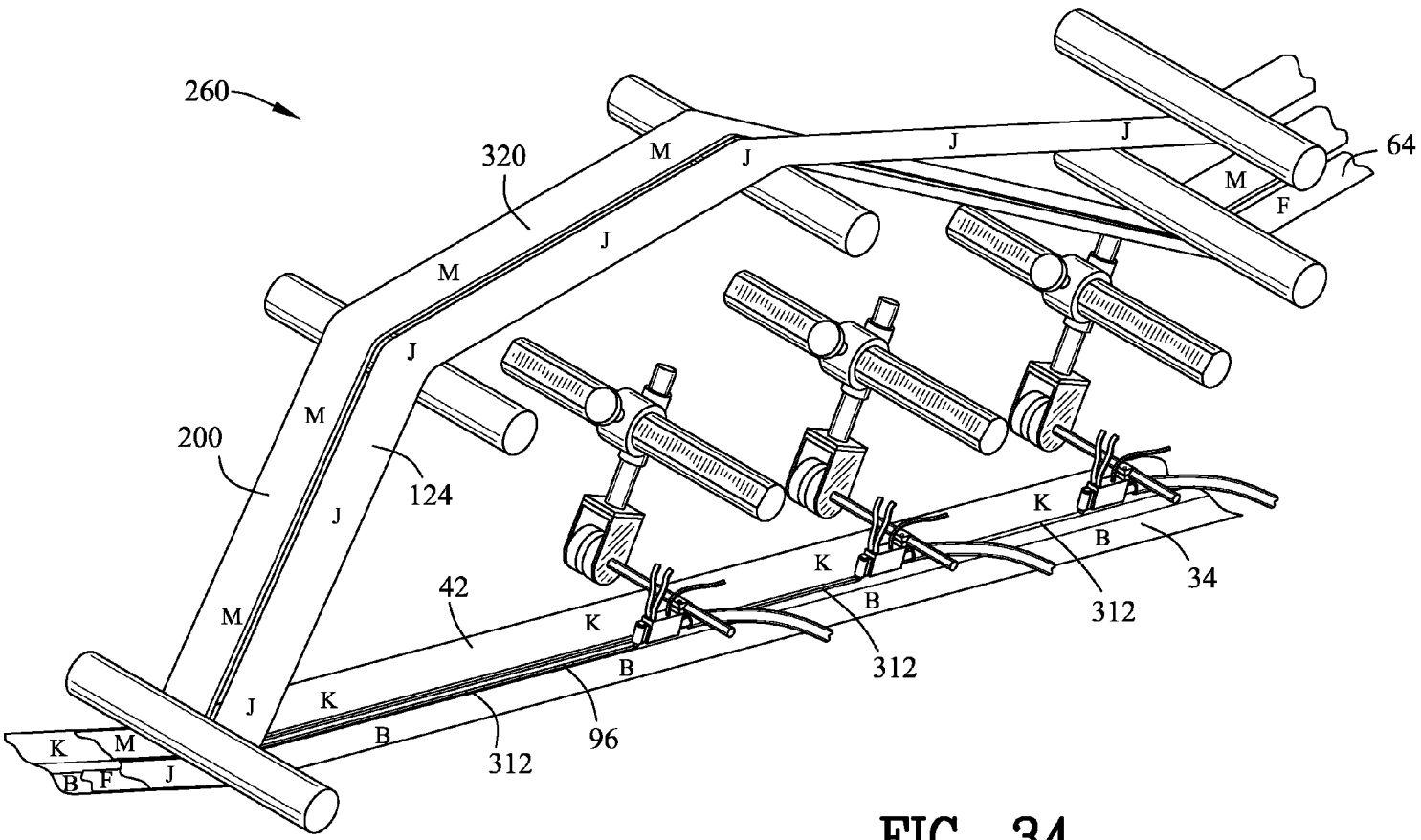
FIG. 34 is an isometric view similar to FIG. 19 with an addition glue applicator applying the glue to the first ribbon and thereafter binding the inner edge of the back interior leaf with the obverse side of the rear cover for defining a back leaf offset dimension between the hinge fold and the inner edge of the back interior leaf.
Figure 35:
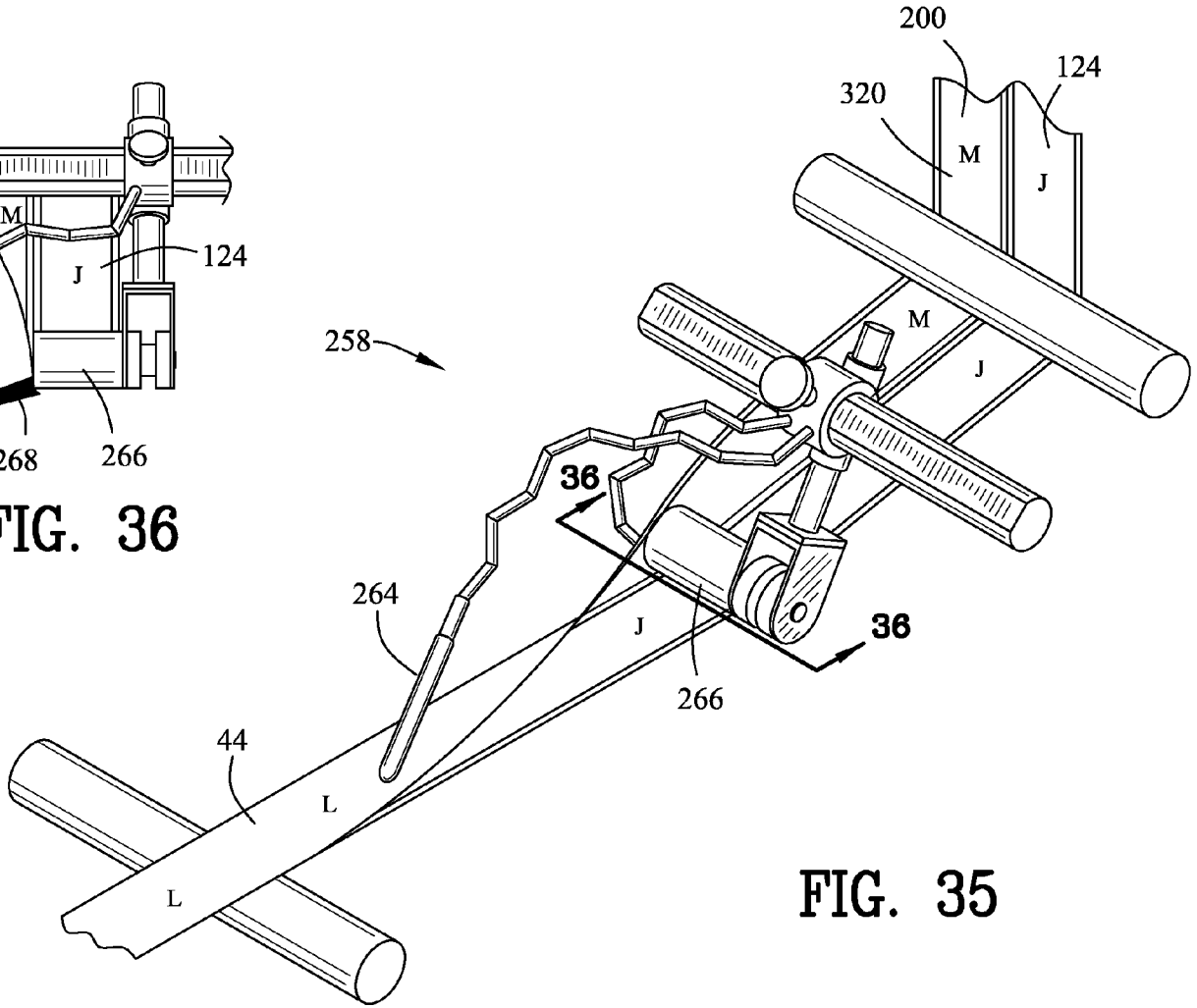
FIG. 35 is an isometric view similar to FIG. 20 wherein the first ribbon, the second ribbon, the third ribbon and the back interior ribbon enter the first plow folding station for folding the first ribbon to define a hinge fold and positioning the interior leaf, the second interior leaf, the third interior leaf and the fourth interior leaf between the front cover and the rear cover.
Figure 36:
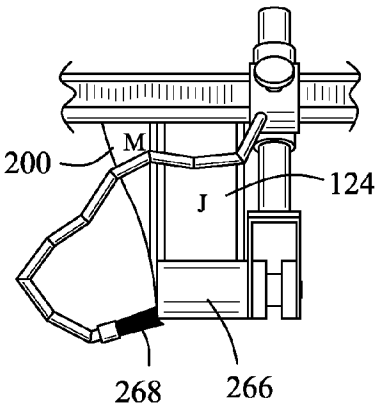
FIG. 36 is atop view of FIG. 35.
Figure 37:
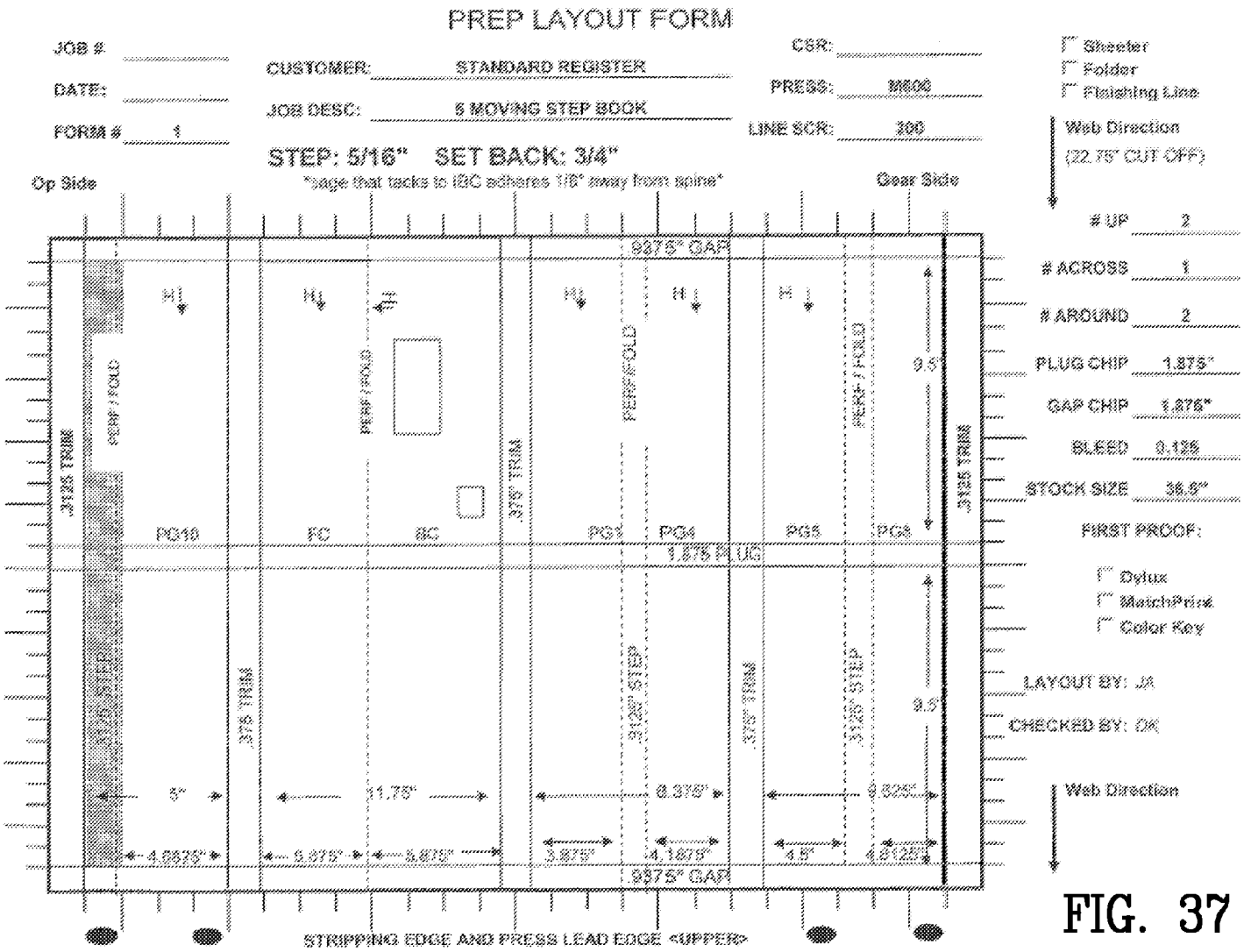
FIG. 37 is a preparation layout form for a five (5) moving step book.
Figure 38:
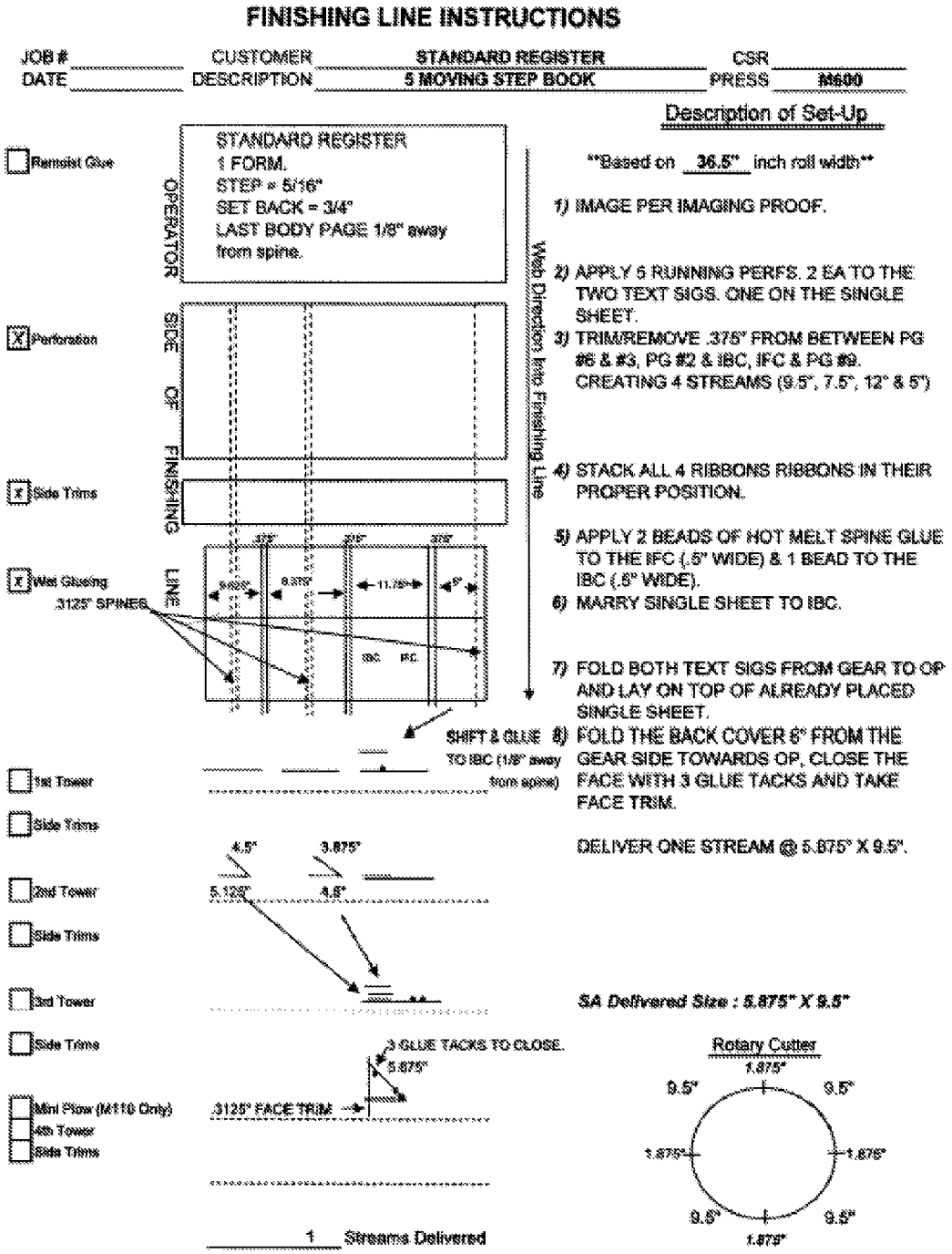
FIG. 38 is finishing line instructions for a five (5) moving step book of FIG. 37.
Figure 39:
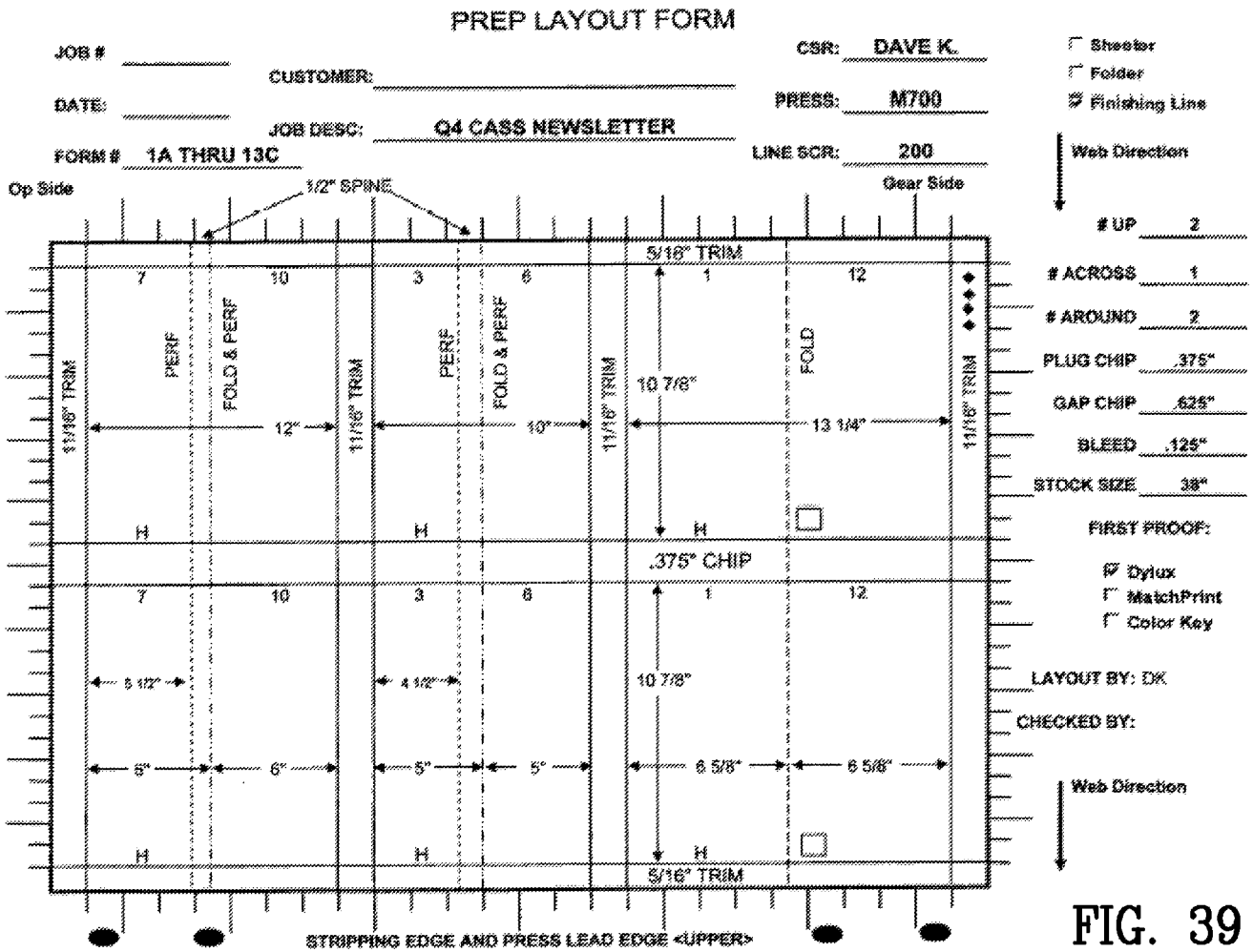
FIG. 39 is a preparation layout form for a Q4 cass Newsletter.
Figure 40:
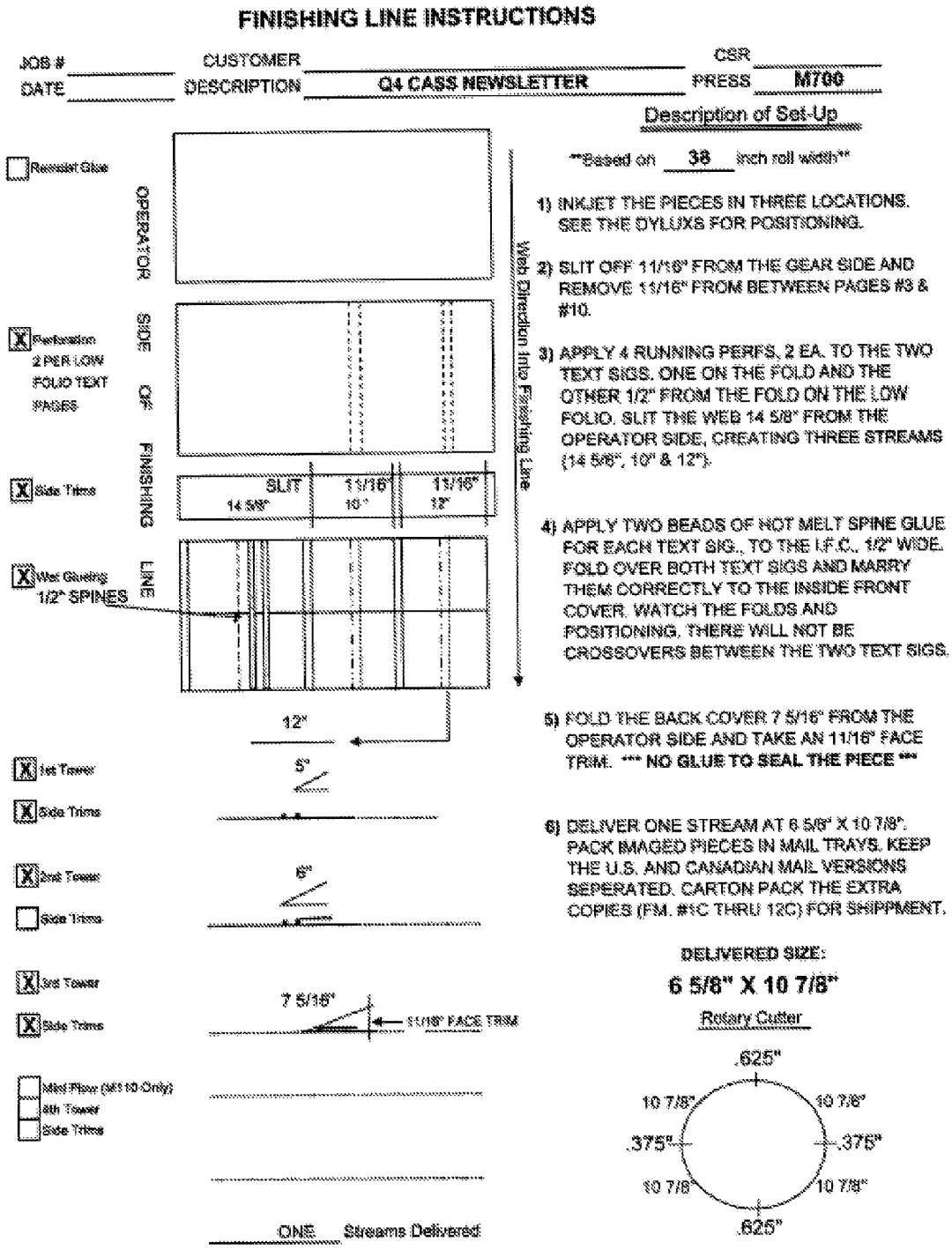
FIG. 40 is a finishing line instructions for a Q4 cass Newsletter of FIG. 39.

FIGS. 34 and 35 illustrate the method utilized for manufacturing the moving step article 10 as shown in FIGS. 29-33. A fourth ribbon 320 is inputted into the line printing press 230 to define a lower side 222 of a back spine sheet 220 positioned adjacent to an obverse side 202 of a back interior leaf 200 (M) and a reverse side 204 of the back interior leaf 200 (N). A fifth perforation 224 is perforated into the fourth ribbon 320 between the back spine sheet 220 and the back interior leaf 200 to define a primary hinge 226 and a rear leaf width 209 in the back interior leaf 200. Thereafter, the lower side 222 of the back spine sheet 220 is bound to the obverse side 42 of the rear cover 40 (K) by a line of binder 96 to define a rear step display tab area 214 on the obverse side 202 of the back interior leaf 200 wherein the first ribbon 276 is a non-folded position or a folded position.

Figure 23:
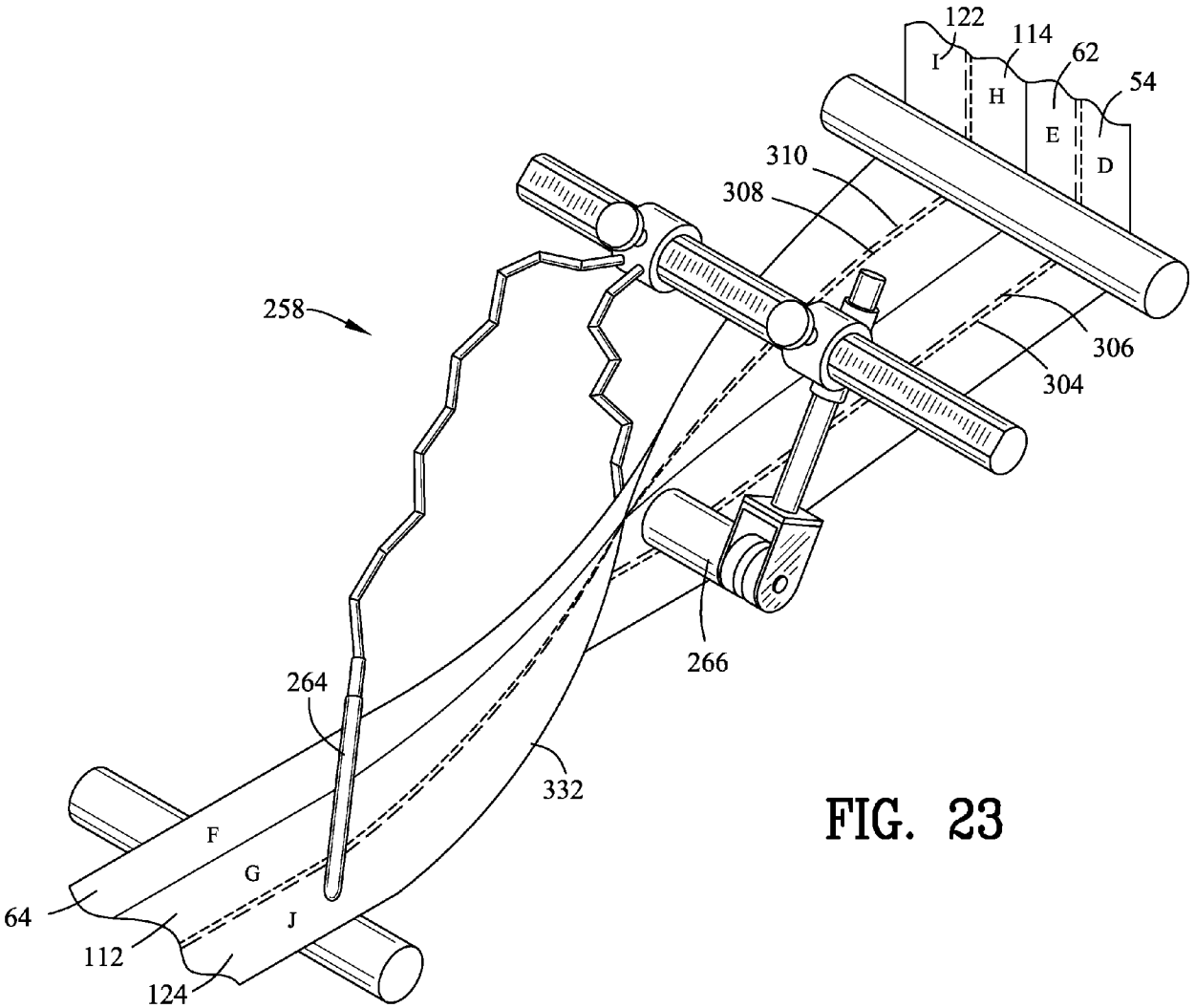
FIG. 23 is an isometric view of a portion of the line printing press of FIG. 12 illustrating a second method for manufacturing a moving step article including a continuous ribbon enters a first plow folding station for folding the second ribbon between the spine sheet and the second interior leaf to define a secondary hinge and a second leaf width in the second interior leaf that is a greater width than the leaf width and positioning the reverse side of the interior leaf (D) adjacent to the obverse side of the second interior leaf (E)

FIGS. 23-22 illustrate an alternative method utilized for manufacturing the moving step article 10 as shown in FIGS. 1-11. A first continuous ribbon of material 330 is inputted into the line printing press 230. The first continuous ribbon 330 is defined by an obverse side 32 of a front cover 30 (A) and a reverse side 44 of a rear cover 40 (L) on a primary ribbon side 278 and a reverse side 34 of the front cover 30 (B) and an obverse side 42 of the rear cover 40 (K) on a secondary ribbon side 280.

A second continuous ribbon of material 332 is inputted into the line printing press 230. The second ribbon is defined by a sequential positioning of an obverse side 52 of an interior leaf 50 (C), a lower side 84 of a spine sheet 80, a reverse side 64 of a second interior leaf 60 (F), an obverse side 112 of an third interior leaf 110 (G), a lower side 144 of a second spine sheet 140, and a reverse side 124 of a fourth interior leaf 120 (J) on a primary ribbon side 278 and a reverse side 54 of the interior leaf 50 (D), an upper side 82 of the spine sheet 80, an obverse side 62 of the second interior leaf 60 (E), a reverse side 114 of the third interior leaf 110 (H), an upper side 142 of the second spine sheet 140, and an obverse side 122 of the fourth interior leaf 120 (I) on a secondary ribbon side 280 and wherein each of the leafs have an progressive increasing width.

As shown in FIG. 23, the second ribbon 332 is first folded between the spine sheet 80 and the second interior leaf 60 to define a secondary hinge 92 and a second leaf width 69 in the second interior leaf 60 that is a greater width than the leaf width 59 and positioning the reverse side 54 of the interior leaf 50 (D) adjacent to the obverse side 62 of the second interior leaf 60 (E).

Figure 24:
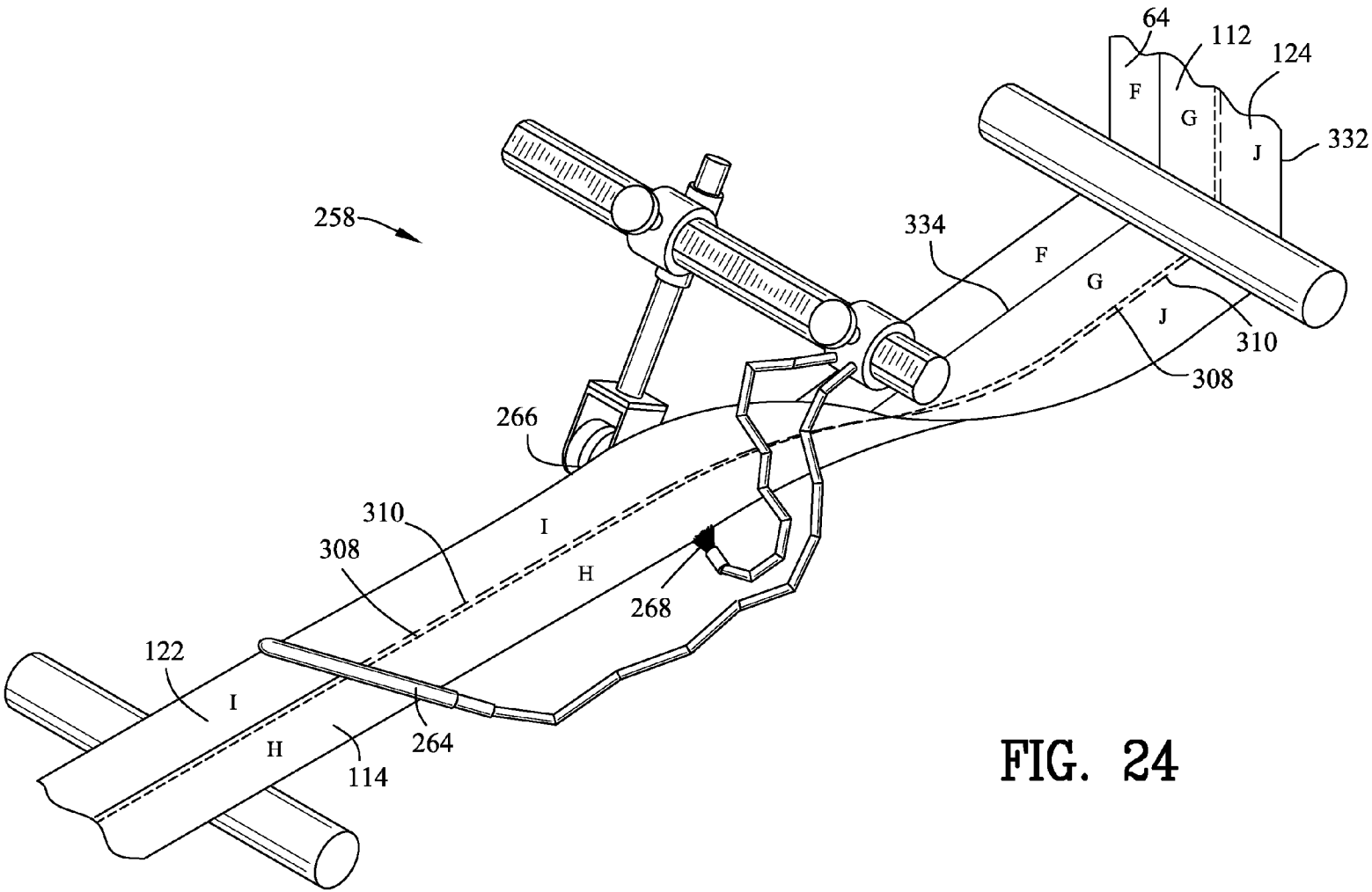
FIG. 24 is an isometric view of a portion illustrating the continuous ribbon entering a second plow folding station for folding the second ribbon between the reverse side of the second interior leaf (F) and the obverse side of the third interior leaf (G) to defining a cut separation crease.

In FIG. 24, the second ribbon 332 is then folded between the reverse side 64 of the second interior leaf 60 (F) and the obverse side 112 of the third interior leaf 110 (G) to defining a cut separation crease 334.

Figure 25:
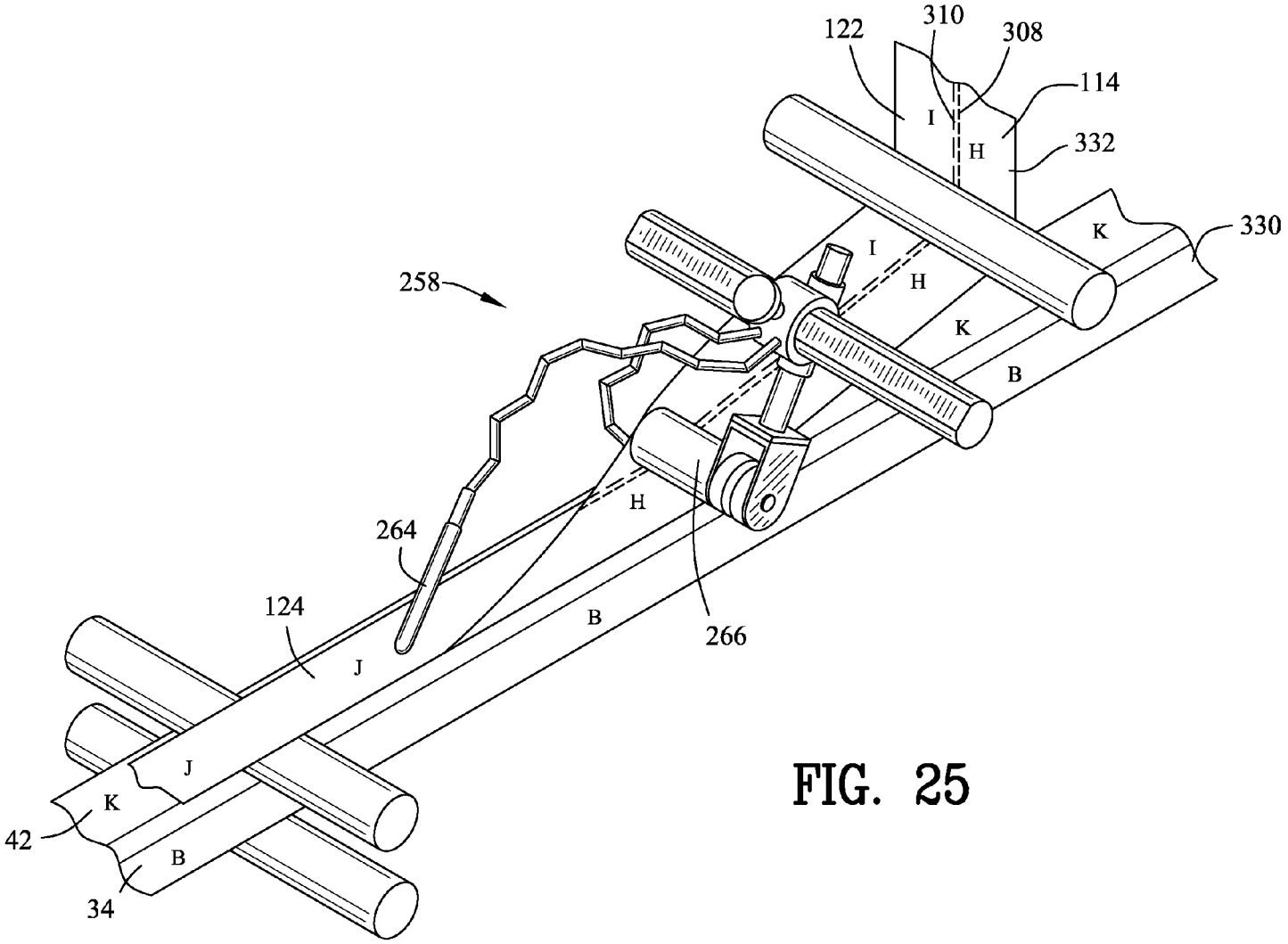
FIG. 25 is an isometric view of a portion illustrating the continuous ribbon entering a third plow folding station for folding the second ribbon between the second spine sheet and the fourth interior leaf to define the secondary hinge and the fourth leaf width in the fourth interior leaf that is a greater width than the third leaf width and positioning the reverse side of the third interior leaf (H) adjacent to the obverse side of the fourth interior leaf (I)

In FIG. 25, the second ribbon 332 is then folded between the second spine sheet 140 and the fourth interior leaf 120 to define the secondary hinge 152 and the fourth leaf width 129 in the fourth interior leaf 120 that is a greater width than the third leaf width 119 and positioning the reverse side 114 of the third interior leaf 110 (H) adjacent to the obverse side 122 of the fourth interior leaf 120.

Figure 26:
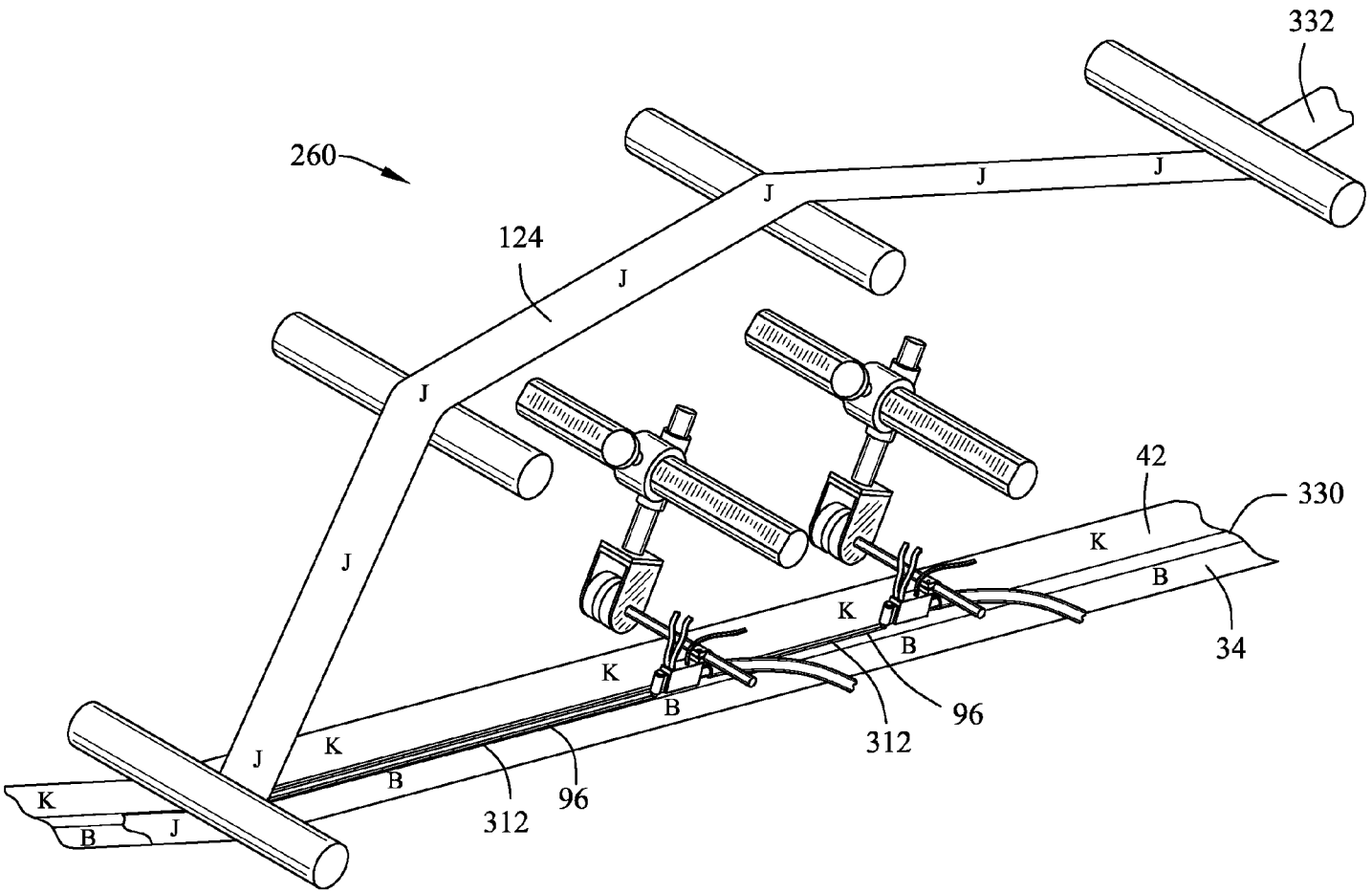
FIG. 26 is an isometric view of a hot melt glue applicator station applying glue to a first ribbon and thereafter binding the lower side of the spine sheet to the reverse side of the front cover (B) to define a step display tab area on the obverse side of the second interior leaf wherein the first ribbon is a non-folded position and binding the lower side of the second spine sheet to the reverse side of the front cover (B) to define a second step display tab area on the obverse side of the third interior leaf (G) and a third step display tab area on the obverse side of the fourth interior leaf (I) wherein the first ribbon is a non-folded position.

FIG. 26 illustrates the step of binding the lower side 84 of the spine sheet 80 to the reverse side 34 of the front cover 30 (B) to define a step display tab area 100 on the obverse side 62 of the second interior leaf 60 wherein the first ribbon 330 is a non-folded position. The lower side 144 of the second spine sheet 140 is also bound to the reverse side 34 of the front cover 30 (B) to define a second step display tab area 170 on the obverse side 112 of the third interior leaf 110 (G) and a third step display tab area 172 on the obverse side 122 of the fourth interior leaf 120 (I) wherein the first ribbon 330 is a non-folded position.

Figures 27, 28:
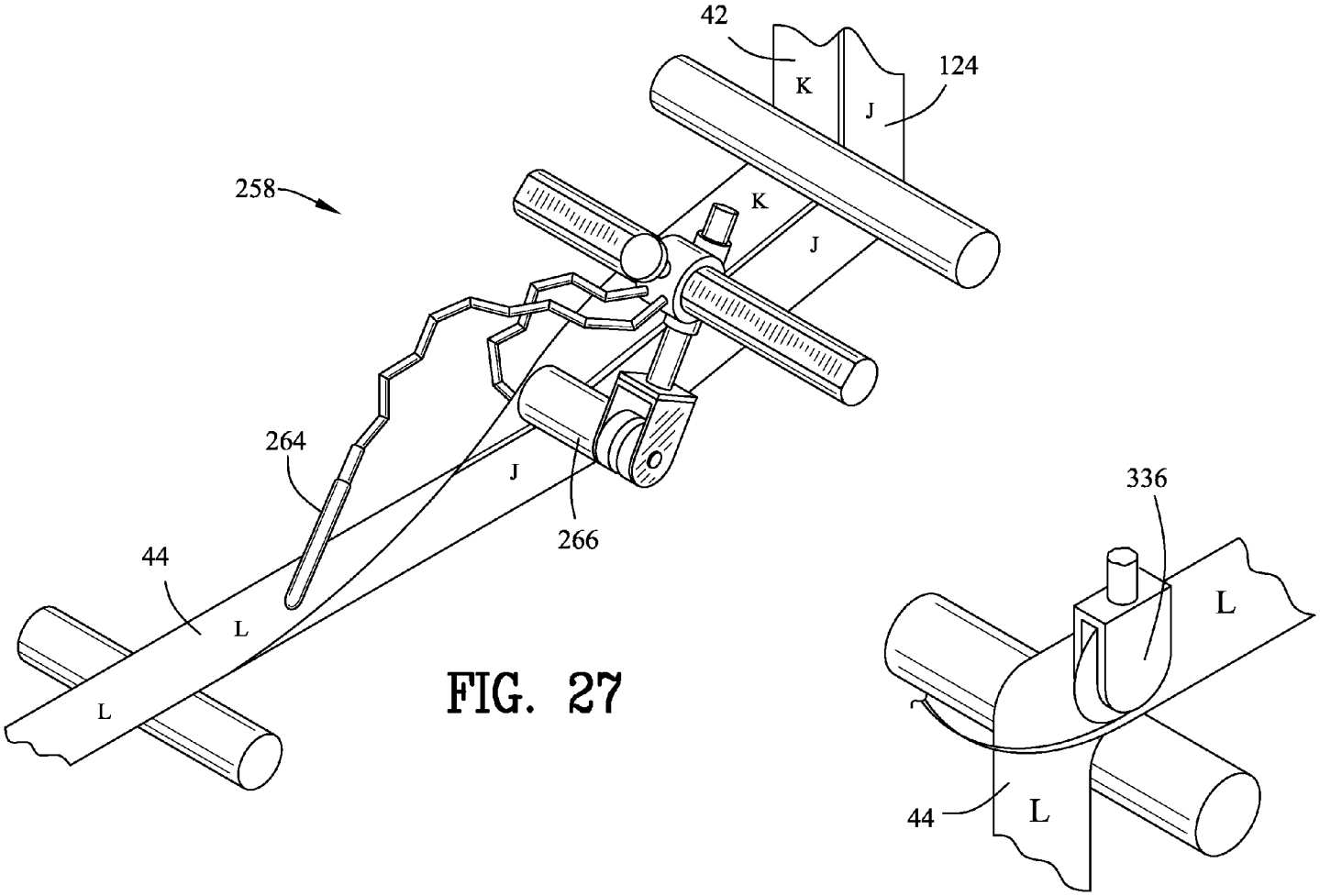
FIG. 27 is an isometric view of the first ribbon and the continuous ribbon entering a fourth plow folding station for folding the first ribbon to define a hinge fold and positioning the interior leaf, the second interior leaf, the third interior leaf and the fourth interior leaf between the front cover and the rear cover.
FIG. 28 is an isometric view of the first ribbon and the continuous ribbon engaging a cutting wheel for cutting the width of the first ribbon and the cut separation crease for separating the second interior leaf (F) with the third interior leaf (G) and thereafter engaging the a rotary cutter station for cutting the first ribbon and the continuous ribbon to length as shown in FIG. 22.
Figure 29:
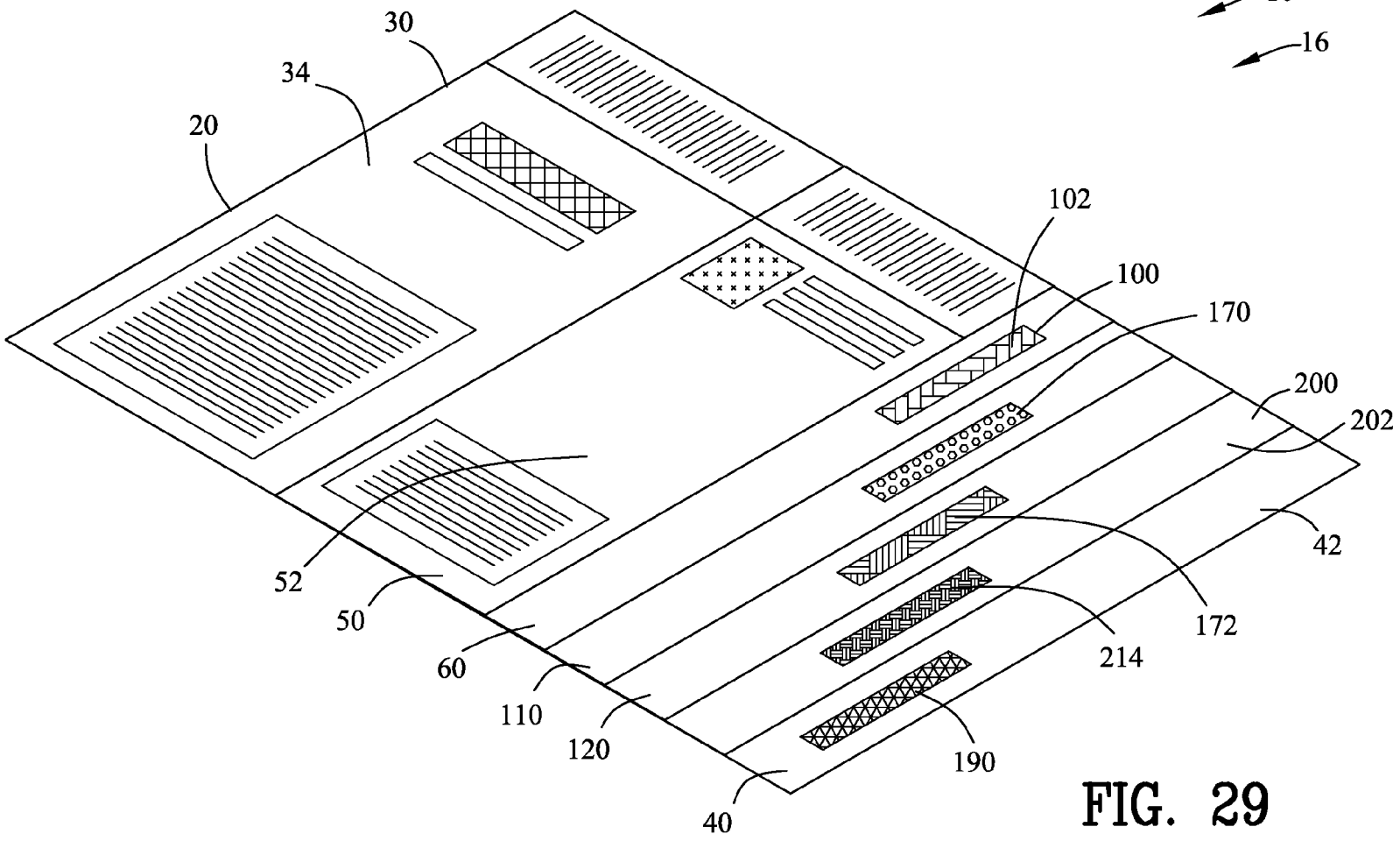
FIG. 29 is an isometric view of a second embodiment of a moving step article of the present invention in an open position.
Figure 30:
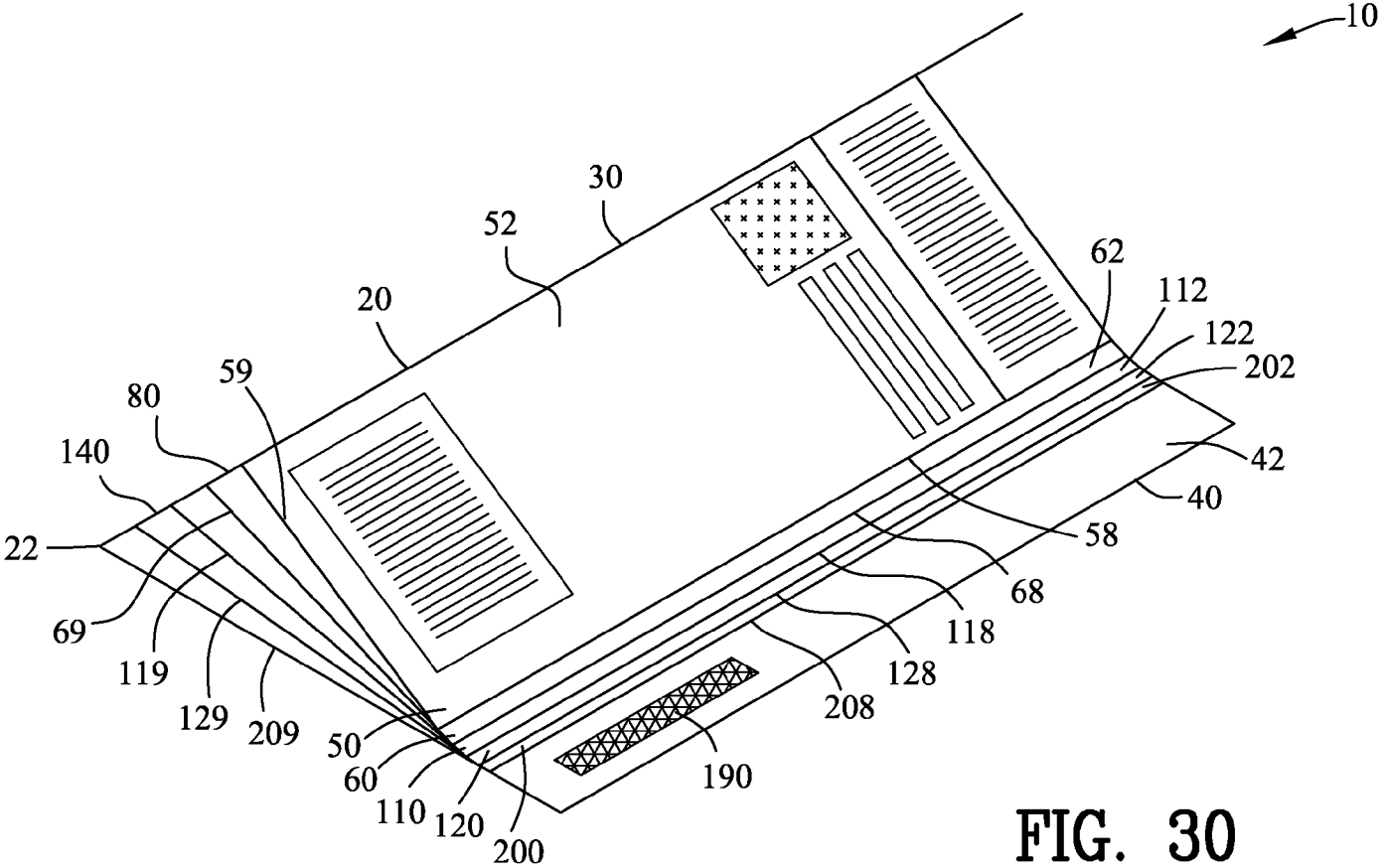
FIG. 30 is an isometric view similar to FIG. 29 illustrating the front cover of the moving step article in a first transitional position for placing the moving step article from the closed position into the open position and having a back leaf bound to a obverse side of a rear cover causing the back interior leaf to be non-displaced relative to the rear cover during pivoting the front cover between the closed position and the open position.
Figure 31:
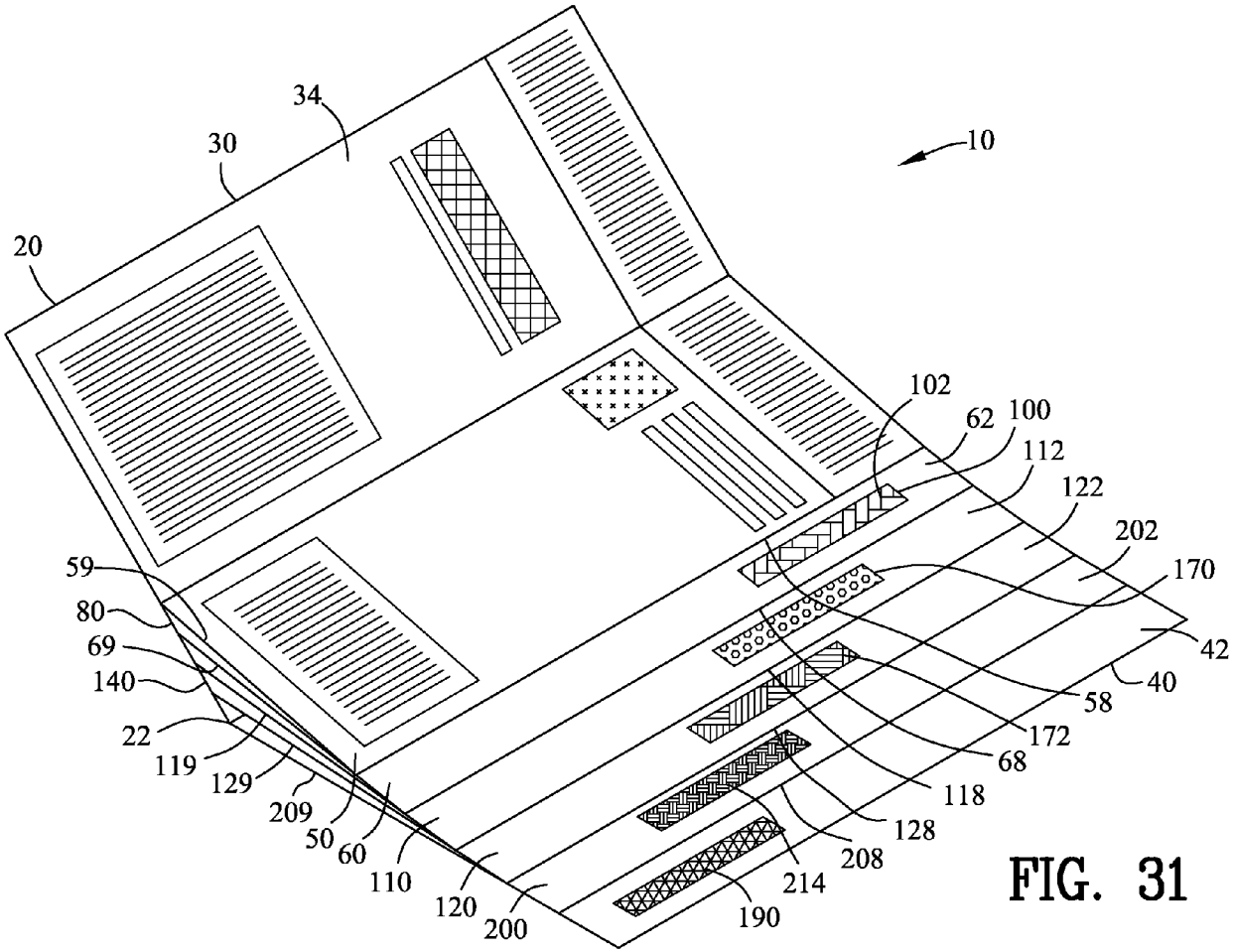
FIG. 31 is an isometric view similar to FIG. 30 illustrating the front cover of the moving step article in a second transitional position for placing the moving step article from the closed position into the open position wherein back interior leaf to be non-displaced relative to the rear cover during pivoting the front cover between the closed position and the open position.
Figure 32:
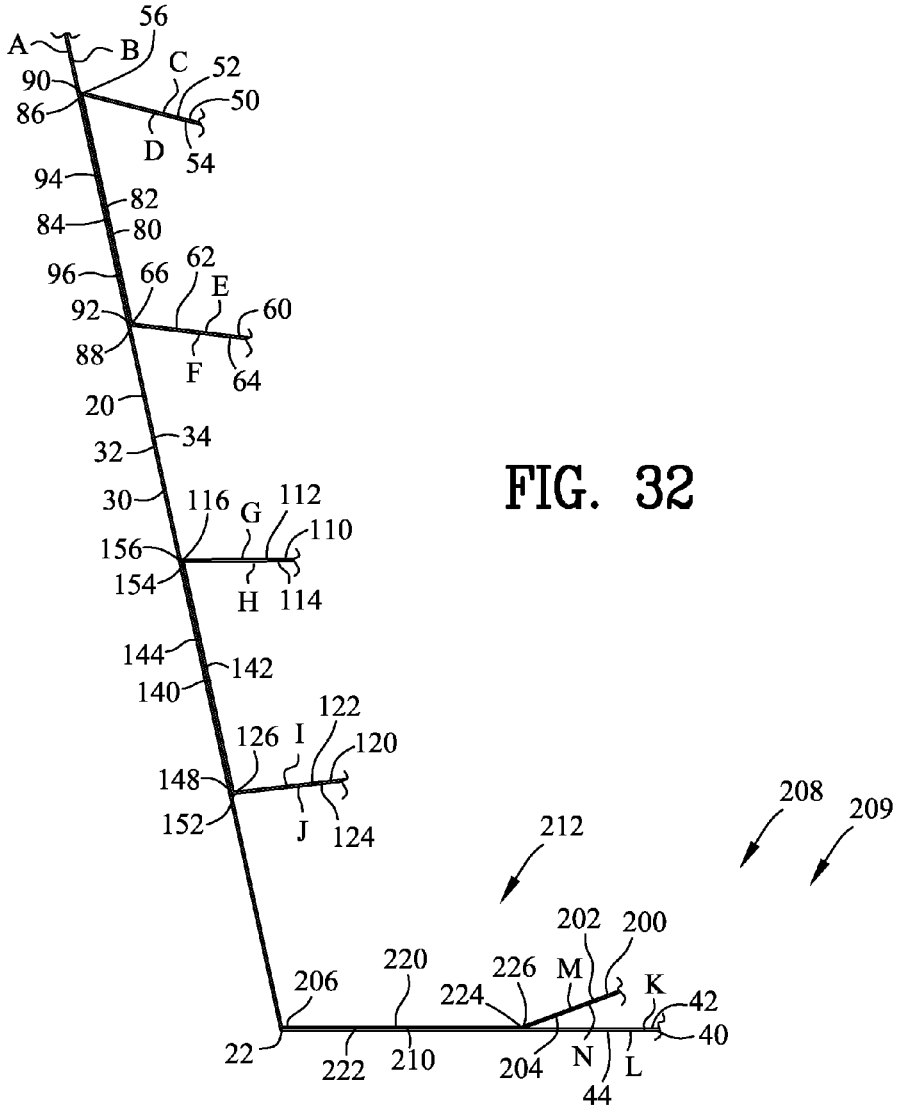
FIG. 32 is a bottom view of FIG. 31 in FIG. 31.
Figure 33:
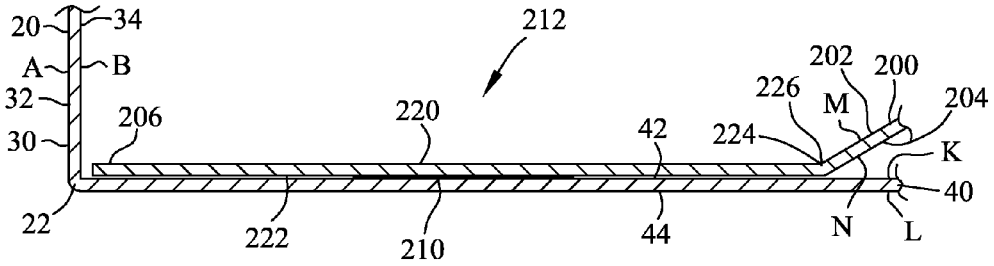
FIG. 33 is a magnified view of a lower portion of FIG. 32 illustrating a back binder coupling the inner edge of the back interior leaf with the obverse side of the rear cover for defining a back leaf offset dimension between the hinge fold and the inner edge of the back interior leaf.

FIG. 27 illustrates the step of folding the first ribbon 330 to define a hinge fold 22 and positioning the interior leaf 50, the second interior leaf 60, the third interior leaf 110 and the fourth interior leaf 120 between the front cover 30 and the rear cover 40.

FIG. 28 illustrates the step of cutting the width of the first ribbon 330 and the cut separation crease 334 by a wheel cutter 336 for separating the second interior leaf 60 (F) with the third interior leaf 110 (G). The final step includes cutting the first ribbon 330 to length as shown in FIG. 22.

Moving Steps Book Features:

Unique, high impact, interactive concept

Magazine/Newspaper Insert, Self Mailer

Available in various sizes, including aspect ratio for mailing

Step size and travel distance is variable 8, 10 or 12 pages (2, 3 or 4 moving pages respectively)

Two pages per spine—pages lay flat, minimal image loss at seam

Pages can be contour die cut, individually die cut or straight edge

Cost effective, comparable to standard spine-glued, die cut books

Unlike any other spine glued book with conventional stepped pages, the Moving Steps Book features an automatic fanning of the pages as the book is opened. The reader actually observes as a portion (step) of each of the following pages is being revealed on the right hand side, ultimately creating a series of equally spaced page tabs. The movement of the pages is quite engaging to the reader since it is an unexpected, intriguing occurrence which encourages additional involvement. Also, the stepped pages are ideal for indexing the book's contents to facilitate the description of products or services.

Only two pages are attached to the multiple, widened glued seams which enable them to conveniently lay flat rather than having the usual and annoying tendency to close shut on the reader. This feature also eliminates most image loss found in other glue bound books. The appeal and function of this book can be further enhanced by die cutting with either a common to all pages (contour) or a page specific shaped die.

Manufacturing a Moving Steps Book is similar to producing conventional spine glued, static pages books and therefore should be comparable in cost. Traditional books are produced by gluing all pages to the center spread or fold line. Whereas this can necessitate more than one line of glue, depending on page count, all seams are placed on the same axis. The departure for a Moving Steps Book is to provide a gap between the glue streams at a distance of one half the desired page travel and resulting step size. Adding a perforation to each page parallel to, but not touching the glue stream, enables the pages to "break" (lay flat) rather than "fly" when the book is opened. Possible prior art with any in-line finishing plant: Web Craft, R R Donnelley, Lehigh, Vertis Communications, Concord Litho, etc.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A moving step article manufactured using a line printing press, comprising:

a first ribbon defining an obverse side of a front cover and a reverse side of a rear cover on a primary ribbon side and a reverse side of said front cover and an obverse side of said rear cover on a secondary ribbon side;

said front cover and said rear cover defining a first continuous one-piece unit made of a first single material;

a hinge fold positioned between said front cover and said rear cover for pivoting said front cover between a closed position and an open position;

a second ribbon defining a lower side of a first spine sheet positioned between an obverse side of an interior leaf and a reverse side of a second interior leaf on a primary ribbon side and an upper side of said first spine sheet positioned between a reverse side of said interior leaf and an obverse side of said second interior leaf on a secondary ribbon side;

said interior leaf, said first spine sheet and said second interior leaf defining a second continuous one-piece unit made of a second single material;

a primary hinge in said second ribbon between said first spine sheet and said interior leaf for defining a leaf width in said interior leaf;

a secondary hinge in said second ribbon between said first spine sheet and said second interior leaf for defining a second leaf width in said second interior leaf;

a binder coupling said lower side of said first spine sheet to said reverse side of said front cover for defining a leaf offset dimension between said hinge fold and said interior leaf and a second leaf offset dimension between said hinge fold and said second interior leaf;

said leaf offset causing said interior leaf to be displaced relative to said rear cover during pivoting said front cover between said closed position and said open position;

said second leaf offset causing said second interior leaf to be displaced relative to said rear cover during pivoting said front cover between said closed position and said open position;

a third ribbon defining a lower side of a second spine sheet positioned between an obverse side of an third interior leaf and a reverse side of a fourth interior leaf on a primary ribbon side and an upper side of said second spine sheet positioned between a reverse side of said third interior leaf and an obverse side of said fourth interior leaf on a secondary ribbon side;

said third interior leaf, said second spine sheet and said fourth interior leaf defining a third continuous one-piece unit made of a third single material;

a primary hinge in said third ribbon between said second spine sheet and said third interior leaf to define a third leaf width in said third interior leaf;

a secondary hinge in said third ribbon between said second spine sheet and said fourth interior leaf to define a fourth leaf width in said fourth interior leaf;

a second binder coupling said lower side of said second spine sheet with said reverse side of said front cover for defining a third leaf offset dimension between said hinge fold and said third interior leaf and a fourth leaf offset dimension between said hinge fold and said fourth interior leaf;

said third leaf offset causing said third interior leaf to be displaced relative to said rear cover during pivoting said front cover between said closed position and said open position;

said fourth leaf offset causing said fourth interior leaf to be displaced relative to said rear cover during pivoting said front cover between said closed position and said open position;

said second leaf offset dimension having a second greater offset dimension than said third leaf offset dimension;

said third leaf offset dimension having a third greater offset dimension than said fourth leaf offset dimension;

said second greater width dimension and said second greater offset dimension creating a second step display tab area on said obverse side of said third interior leaf that is progressively revealed adjacent to said outer edge of said second interior leaf during pivoting said front cover between said closed position and said open position;

said third greater width dimension and said third greater offset dimension creating a third step display tab area on said obverse side of said fourth interior leaf that is progressively revealed adjacent to said outer edge of said third interior leaf during pivoting said front cover between said closed position and said open position; and said first spine sheet being discontinuous from said second spine sheet.

2. A moving step article as set forth in claim 1, wherein said second leaf width has a greater width dimension than said leaf width;

said leaf offset dimension having a greater offset dimension than said second leaf offset dimension; and said greater width dimension and said greater offset dimension creating a step display tab area on said obverse side of said second interior leaf that is progressively revealed adjacent to said interior leaf during pivoting said front cover between said closed position and said open position.

3. A moving step article as set forth in claim 2, further including a symbol imprinted on said step display tab identifying a subject matter imprinted on said reverse side of said interior leaf and said obverse side of said second interior leaf.

4. A moving step article as set forth in claim 1, further including a back display tab area on said obverse side of said rear cover that is progressively revealed adjacent to said second interior leaf during pivoting said front cover between said closed position and said open position.

5. A moving step article as set forth in claim 1, wherein said third leaf width having a second greater width dimension than said second leaf width;

said fourth leaf width having a third greater width dimension than said third leaf width; and said third greater width dimension and said third greater offset dimension creating a third step display tab area on said obverse side of said fourth interior leaf that is progressively revealed adjacent to said outer edge of said third interior leaf during pivoting said front cover between said closed position and said open position.

6. A moving step article as set forth in claim 1, wherein said primary hinge includes a primary linear perforation for promoting said interior leaf to maintain a parallel orientation relative to said exterior cover during said open position;

said primary linear perforation defining a first continuous linear perforation in said second single material;

said secondary hinge includes a secondary linear perforation for promoting said second interior leaf to maintain a parallel orientation relative to said exterior cover during said open position; and said secondary linear perforation defining a second continuous linear perforation in said second single material.

7. A moving step article as set forth in claim 1, further including a fourth ribbon defining a lower side of a back spine sheet positioned adjacent to an obverse side of a back interior leaf and a reverse side of said back interior leaf;

said back spine and said back interior leaf defining a fourth continuous one-piece unit made of a fourth single material;

a primary hinge in said fourth ribbon between said back spine sheet and said back interior leaf for defining a rear leaf width in said back interior leaf; and a second binder coupling said lower side of said back spine sheet to said obverse side of the rear cover for defining a rear step display tab area on said obverse side of said back interior leaf that is progressively revealed adjacent to said second interior leaf during pivoting said front cover between said closed position and said open position.

8. A moving step article manufactured using a line printing press, comprising:

a first ribbon defining an obverse side of a front cover and a reverse side of a rear cover on a primary ribbon side and a reverse side of said front cover and an obverse side of said rear cover on a secondary ribbon side;

said front cover and said rear cover defining a first continuous one-piece unit made of a first single material;

a hinge fold positioned between said front cover and said rear cover for pivoting said front cover between a closed position and an open position;

a second ribbon defining a lower side of a first spine sheet positioned between an obverse side of an interior leaf and a reverse side of a second interior leaf on a primary ribbon side and an upper side of said first spine sheet positioned between a reverse side of said interior leaf and an obverse side of said second interior leaf on a secondary ribbon side;

said interior leaf, said first spine sheet and said second interior leaf defining a second continuous one-piece unit made of a second single material;

a primary hinge in said second ribbon between said first spine sheet and said interior leaf for defining a leaf width in said interior leaf;

a secondary hinge in said second ribbon between said first spine sheet and said second interior leaf for defining a second leaf width in said second interior leaf;

a binder coupling said lower side of said first spine sheet to said reverse side of said front cover for defining a leaf offset dimension between said hinge fold and said interior leaf and a second leaf offset dimension between said hinge fold and said second interior leaf;

said leaf offset causing said interior leaf to be displaced relative to said rear cover during pivoting said front cover between said closed position and said open position;

said second leaf offset causing said second interior leaf to be displaced relative to said rear cover during pivoting said front cover between said closed position and said open position;

a single continuous image imprinted on said second ribbon including said reverse side of said interior leaf, said upper side of said spine sheet, and said obverse side of said second interior leaf;

said image defines a flat image in said open position;

a third ribbon defining a lower side of a second spine sheet positioned between an obverse side of an third interior leaf and a reverse side of a fourth interior leaf on a primary ribbon side and an upper side of said second spine sheet positioned between a reverse side of said third interior leaf and an obverse side of said fourth interior leaf on a secondary ribbon side;

said third interior leaf, said second spine sheet and said fourth interior leaf defining a third continuous one-piece unit made of a third single material;

a primary hinge in said third ribbon between said second spine sheet and said third interior leaf to define a third leaf width in said third interior leaf;

a secondary hinge in said third ribbon between said second spine sheet and said fourth interior leaf to define a fourth leaf width in said fourth interior leaf;

a second binder coupling said lower side of said second spine sheet with said reverse side of said front cover for defining a third leaf offset dimension between said hinge fold and said third interior leaf and a fourth leaf offset dimension between said hinge fold and said fourth interior leaf;

said third leaf offset causing said third interior leaf to be displaced relative to said rear cover during pivoting said front cover between said closed position and said open position;

said fourth leaf offset causing said fourth interior leaf to be displaced relative to said rear cover during pivoting said front cover between said closed position and said open position;

said second leaf offset dimension having a second greater offset dimension than said third leaf offset dimension;

said third leaf offset dimension having a third greater offset dimension than said fourth leaf offset dimension;

said second greater width dimension and said second greater offset dimension creating a second step display tab area on said obverse side of said third interior leaf that is progressively revealed adjacent to said outer edge of said second interior leaf during pivoting said front cover between said closed position and said open position;

said third greater width dimension and said third greater offset dimension creating a third step display tab area on said obverse side of said fourth interior leaf that is progressively revealed adjacent to said outer edge of said third interior leaf during pivoting said front cover between said closed position and said open position; and said first spine sheet being discontinuous from said second spine sheet.

9. A moving step article, comprising:

an exterior cover having a hinge fold positioned between a front cover and a rear cover for pivoting said front cover between a closed position and an open position;

said front cover having an obverse side and a reverse side;

said rear cover having an obverse side and a reverse side;

said front cover and said rear cover defining a first continuous one-piece unit made of a first single material;

an interior leaf having an obverse side, a reverse side, an inner edge and an outer edge;

a second interior leaf having an obverse side, a reverse side, an inner edge and an outer edge;

a first spine sheet having an upper side, a lower side, a primary edge and a secondary edge;

a primary hinge coupling said primary edge of said first spine sheet with said inner edge of said interior leaf;

a secondary hinge coupling said secondary edge of said first spine sheet with said inner edge of said second interior leaf;

said interior leaf, said first spine sheet and said second interior leaf defining a second continuous one-piece unit made of a second single material;

a binder coupling said lower side of said first spine sheet with said reverse side of said front cover for defining a leaf offset dimension between said hinge fold and said inner edge of said interior leaf and a second leaf offset dimension between said hinge fold and said inner edge of said second interior leaf;

said leaf offset causing said interior leaf to be displaced relative to said rear cover during pivoting said front cover between said closed position and said open position;

said second leaf offset causing said second interior leaf to be displaced relative to said rear cover during pivoting said front cover between said closed position and said open position;

a third ribbon defining a lower side of a second spine sheet positioned between an obverse side of an third interior leaf and a reverse side of a fourth interior leaf on a primary ribbon side and an upper side of said second spine sheet positioned between a reverse side of said third interior leaf and an obverse side of said fourth interior leaf on a secondary ribbon side;

said third interior leaf, said second spine sheet and said fourth interior leaf defining a third continuous one-piece unit made of a third single material;

a primary hinge in said third ribbon between said second spine sheet and said third interior leaf to define a third leaf width in said third interior leaf;

a secondary hinge in said third ribbon between said second spine sheet and said fourth interior leaf to define a fourth leaf width in said fourth interior leaf;

a second binder coupling said lower side of said second spine sheet with said reverse side of said front cover for defining a third leaf offset dimension between said hinge fold and said third interior leaf and a fourth leaf offset dimension between said hinge fold and said fourth interior leaf;

said third leaf offset causing said third interior leaf to be displaced relative to said rear cover during pivoting said front cover between said closed position and said open position;

said fourth leaf offset causing said fourth interior leaf to be displaced relative to said rear cover during pivoting said front cover between said closed position and said open position; and said first spine sheet being discontinuous from said second spine sheet.

10. A moving step article as set forth in claim 9, wherein said primary hinge includes a primary linear perforation for promoting said interior leaf to maintain a parallel orientation relative to said exterior cover during said open position;

said primary linear perforation defining a first continuous linear perforation in said second single material;

said secondary hinge includes a secondary linear perforation for promoting said second interior leaf to maintain a parallel orientation relative to said exterior cover during said open position; and said secondary linear perforation defining a second continuous linear perforation in said second single material.

* * * * *